US011268161B2

(12) United States Patent
Kamo et al.

(10) Patent No.: US 11,268,161 B2
(45) **Date of Patent: *Mar. 8, 2022**

(54) HIGH STRENGTH SEAMLESS STAINLESS STEEL PIPE AND METHOD FOR PRODUCING SAME

(71) Applicant: JFE Steel Corporation, Tokyo (JP)

(72) Inventors: Yuichi Kamo, Tokyo (JP); Masao Yuga, Tokyo (JP); Kenichiro Eguchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 252 days.

This patent is subject to a terminal disclaimer.

(21) Appl. No.: 16/477,393

(22) PCT Filed: Dec. 6, 2017

(86) PCT No.: PCT/JP2017/043775

§ 371 (c)(1),
(2) Date: Jul. 11, 2019

(87) PCT Pub. No.: WO2018/131340

PCT Pub. Date: Jul. 19, 2018

(65) Prior Publication Data

US 2019/0368001 A1 Dec. 5, 2019

(30) Foreign Application Priority Data

Jan. 13, 2017 (JP) ..... JP2017-003970

(51) Int. Cl.

| | |
|---|---|
| ***C22C 38/04*** | (2006.01) |
| ***C21D 9/08*** | (2006.01) |
| ***C21D 6/00*** | (2006.01) |
| ***C21D 8/10*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C21D 9/085* (2013.01); *C21D 6/004* (2013.01); *C21D 6/005* (2013.01); *C21D 6/007* (2013.01); *C21D 6/008* (2013.01); *C21D 8/105* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/001* (2013.01); *C21D 2211/005* (2013.01); *C21D 2211/008* (2013.01)

(58) Field of Classification Search

CPC ..... C22C 38/04

See application file for complete search history.

(56) References Cited

U.S. PATENT DOCUMENTS

| | | | |
|---|---|---|---|
| 7,767,037 | B2 | 8/2010 | Kimura et al. |
| 7,806,993 | B2 | 10/2010 | Miyazaki et al. |
| 7,842,141 | B2 | 11/2010 | Kimura et al. |
| 8,608,872 | B2 | 12/2013 | Kondo et al. |
| 9,322,087 | B2 | 4/2016 | Takabe et al. |
| 9,783,876 | B2 | 10/2017 | Nakatsuka et al. |
| 10,151,011 | B2 | 12/2018 | Eguchi et al. |
| 10,876,183 | B2 | 12/2020 | Eguchi et al. |
| 2006/0060270 | A1 | 3/2006 | Klueh et al. |
| 2015/0047831 | A1 | 2/2015 | Nakatsuka et al. |
| 2015/0152531 | A1 | 6/2015 | Eguchi et al. |
| 2015/0315684 | A1 | 11/2015 | Eguchi et al. |
| 2016/0369382 | A1 | 12/2016 | Oliver et al. |
| 2017/0275723 | A1 | 9/2017 | Abe et al. |
| 2019/0100821 | A1 | 4/2019 | Eguchi et al. |
| 2019/0106775 | A1 | 4/2019 | Nishida et al. |
| 2019/0177824 | A1 | 6/2019 | Ichikawa et al. |
| 2019/0177825 | A1 | 6/2019 | Yano et al. |

(Continued)

FOREIGN PATENT DOCUMENTS

| | | | |
|---|---|---|---|
| JP | 2005336595 | A | 12/2005 |
| JP | 2008081793 | A | 4/2008 |

(Continued)

OTHER PUBLICATIONS

International Search Report and Written Opinion for International Application No. PCT/JP2017/043775, dated Mar. 13, 2018—4 pages.

(Continued)

*Primary Examiner* — Jophy S. Koshy

(74) *Attorney, Agent, or Firm* — RatnerPrestia

(57) ABSTRACT

Provided herein is a high strength seamless stainless steel pipe. A method for producing such a high strength seamless stainless steel pipe is also provided. The high strength seamless stainless steel pipe has a certain composition. The high strength seamless stainless steel pipe has a structure that includes a tempered martensite phase as a primary phase, and 20 to 40% ferrite phase, and at most 25% residual austenite phase in terms of a volume fraction, and in which C, Cr, Ni, Mo, Nb, N, W, and Cu in the residual austenite phase satisfy a predetermined formula.

8 Claims, No Drawings

(56) References Cited

U.S. PATENT DOCUMENTS

| | | | |
|---|---|---|---|
| 2019/0296369 | A1 | 9/2019 | Yano et al. |
| 2019/0305328 | A1 | 10/2019 | Yano et al. |
| 2019/0368001 | A1 | 12/2019 | Kamo et al. |
| 2019/0376157 | A1 | 12/2019 | Kamo et al. |
| 2020/0002779 | A1 | 1/2020 | Yoshino |
| 2020/0080181 | A1 | 3/2020 | Ichikawa et al. |
| 2020/0157646 | A1 | 5/2020 | Eguchi et al. |
| 2020/0216936 | A1 | 7/2020 | Kamo et al. |

FOREIGN PATENT DOCUMENTS

| | | | |
|---|---|---|---|
| JP | 2008297602 | A | 12/2008 |
| JP | 2010209402 | A | 9/2010 |
| JP | 2010242163 | A | 10/2010 |
| JP | 2012149317 | A | 8/2012 |
| JP | 2015096648 | A1 | 5/2015 |
| JP | 2015110822 | A | 6/2015 |
| JP | 2015161010 | A | 9/2015 |
| JP | 2016033237 | A | 3/2016 |
| JP | 2016089272 | A | 5/2016 |
| JP | 2016132821 | A | 7/2016 |
| WO | 2010050519 | A1 | 5/2010 |
| WO | 2010134498 | A1 | 11/2010 |
| WO | 2013146046 | A1 | 10/2013 |
| WO | 2014097628 | A1 | 6/2014 |
| WO | 2015127523 | A1 | 9/2015 |
| WO | 2016079920 | A1 | 5/2016 |
| WO | 2016079922 | A1 | 5/2016 |

OTHER PUBLICATIONS

Non Final Office Action for U.S. Appl. No. 16/076,138, dated Oct. 28, 2020, 11 pages.

Non Final Office Action for U.S. Appl. No. 16/318,976, dated Oct. 28, 2020, 22 pages.

European Communication Pursuant to Article 94(3) EPC for European Application No. 17 890 889.3, dated Jun. 28, 2021, 3 pages.

Final Office Action for U.S. Appl. No. 16/615,883, dated Jan. 22, 2021, 27 pages.

Final Office Action for U.S. Appl. No. 16/615,883, dated Jan. 22, 2021, 21 pages.

Non Final Office Action for U.S. Appl. No. 16/325,577, dated Aug. 7, 2020, 28 pages.

Non Final Office Action for U.S. Appl. No. 16/615,883, dated Aug. 7, 2020, 28 pages.

Non Final Office Action for U.S. Appl. No. 16/089,198, dated Dec. 1, 2020, 12 pages.

Final Office Action for U.S. Appl. No. 16/089,198, dated Jul. 8, 2020, 11 pages.

Non Final Office Action for U.S. Appl. No. 16/089,198, dated Apr. 27, 2020, 24 pages.

Non Final Office Action for U.S. Appl. No. 16/089,198, dated Jun. 1, 2021, 12 pages.

Final Office Action for U.S. Appl. No. 16/089,198, dated Feb. 22, 2021, 9 pages.

"Standard Practice for Using Significant Digits in Test Data to Determine Conformance with Specifications", American National Standard, 2013, retrieved from the internet at http://www.galvanizeit.com/uploads/AST M-E-29-yr-13.pdf., 6 pages.

Extended European Search Report for European Application No. 17890889.3, dated Nov. 26, 2019, 10 pages.

Non Final Office Action for U.S. Appl. No. 16/615,883, dated Jun. 24, 2021, 27 pages.

Non Final Office Action for U.S. Appl. No. 15/743,111, dated Jan. 3, 2020, 11 pages.

Final Office Action for U.S. Appl. No. 15/743,111, dated Apr. 28, 2020, 16 pages.

Final Office Action for U.S. Appl. No. 16/089,198, dated Sep. 13, 2021, 9 pages.

HIGH STRENGTH SEAMLESS STAINLESS STEEL PIPE AND METHOD FOR PRODUCING SAME

CROSS REFERENCE TO RELATED APPLICATIONS

This is the U.S. National Phase application of PCT/JP2017/043775, filed Dec. 6, 2017, which claims priority to Japanese Patent Application No. 2017-003970, filed Jan. 13, 2017, the disclosures of these applications being incorporated herein by reference in their entireties for all purposes.

FIELD OF THE INVENTION

The present invention relates to a high strength seamless stainless steel pipe preferred for use in oil well and gas well applications such as in crude oil wells and natural gas wells (hereinafter, simply referred to as "oil country tubular goods"), and to a method for producing such a high strength seamless stainless steel pipe. A high strength seamless stainless steel pipe of the present invention has excellent corrosion resistance in a variety of corrosive environments, particularly in a severe, high-temperature corrosive environment containing carbon dioxide gas ($CO_2$) and chlorine ions ($Cl^-$), and in a hydrogen sulfide ($H_2S$)-containing environment. A high strength seamless stainless steel pipe of the present invention also excels in low-temperature toughness.

BACKGROUND OF THE INVENTION

The possible depletion of petroleum and other energy resources in the near future has prompted active development of deep oil fields that were unthinkable in the past, and oil fields and gas fields of a severe corrosive environment, or a sour environment as it is also called, where hydrogen sulfide and other corrosive gases are present. Such oil fields and gas fields are typically very deep, and involve a severe, high-temperature corrosive environment of an atmosphere containing $CO_2$, $Cl^-$, and $H_2S$. Steel pipe materials for oil country tubular goods intended for such an environment require high strength, excellent low-temperature toughness, and excellent corrosion resistance.

Oil country tubular goods used for mining of oil fields and gas fields of an environment containing $CO_2$ gas, $Cl^-$, and the like typically use 13% Cr martensitic stainless steel pipes. There has also been development of oil wells in a corrosive environment of an even higher temperature (as high as 200° C.). The corrosion resistance of 13% Cr martensitic stainless steel pipes is not always sufficient in such an environment. There accordingly is a need for a steel pipe for oil country tubular goods that has excellent corrosion resistance, and that can be used in these high-temperature corrosive environments.

Out of such demands, for example, PTL 1 describes a high-strength stainless steel pipe for oil country tubular goods having improved corrosion resistance. The high-strength stainless steel pipe is of a composition containing, in mass %, C: 0.005 to 0.05%, Si: 0.05 to 0.5%, Mn: 0.2 to 1.8%, P: 0.03% or less, S: 0.005% or less, Cr: 15.5 to 18%, Ni: 1.5 to 5%, Mo: 1 to 3.5%, V: 0.02 to 0.2%, N: 0.01 to 0.15%, and O: 0.006% or less, in which Cr, Ni, Mo, Cu, and C satisfy a specific relation, and Cr, Mo, Si, C, Mn, Ni, Cu, and N satisfy a specific relation, and has a structure containing a martensite base phase, and 10 to 60% ferrite phase, or at most 30% austenite phase in terms of a volume fraction. In this way, PTL 1 allegedly enables stable provision of a high-strength stainless steel pipe for oil country tubular goods that shows sufficient corrosion resistance against $CO_2$ even in a severe corrosive environment containing $CO_2$, $Cl^-$, or the like where the temperature reaches as high as 230° C., and has high strength with a yield strength of more than 654 MPa (95 ksi), and high toughness.

PTL 2 describes a high-strength stainless steel pipe for oil country tubular goods having high toughness and improved corrosion resistance. The high-strength stainless steel pipe is of a composition containing, in mass %, C: 0.04% or less, Si: 0.50% or less, Mn: 0.20 to 1.80%, P: 0.03% or less, S: 0.005% or less, Cr: 15.5 to 17.5%, Ni: 2.5 to 5.5%, V: 0.20% or less, Mo: 1.5 to 3.5%, W: 0.50 to 3.0%, Al: 0.05% or less, N: 0.15% or less, and O: 0.006% or less, in which Cr, Mo, W, and C satisfy a specific relation, Cr, Mo, W, Si, C, Mn, Cu, Ni, and N satisfy a specific relation, and Mo and W satisfy a specific relation, and has a structure containing a martensite base phase, and 10 to 50% ferrite phase in terms of a volume fraction. In this way, PTL 2 allegedly enables stable provision of a high-strength stainless steel pipe for oil country tubular goods that has high strength with a yield strength of more than 654 MPa (95 ksi), and that shows sufficient corrosion resistance even in a severe, high-temperature corrosive environment containing $CO_2$, $Cl^-$, and $H_2S$.

PTL 3 describes a high-strength stainless steel pipe having improved sulfide stress cracking resistance and improved high-temperature carbon dioxide corrosion resistance. The high-strength stainless steel pipe is of a composition containing, in mass %, C: 0.05% or less, Si: 1% or less, P: 0.05% or less, S: less than 0.002%, Cr: more than 16% and 18% or less, Mo: more than 2% and 3% or less, Cu: 1 to 3.5%, Ni: 3% or more and less than 5%, Al: 0.001 to 0.1%, and O: 0.01% or less, in which Mn and N satisfy a specific relation in a region where Mn is 1% or less, and N is 0.05% or less, and has a structure containing a martensite base phase, and 10 to 40% ferrite phase, and at most 10% residual austenite (γ) phase in terms of a volume fraction. In this way, PTL 3 allegedly enables provision of a high-strength stainless steel pipe having improved corrosion resistance, and high strength with a yield strength of 758 MPa (110 ksi) or more, and in which the corrosion resistance is sufficient even in a carbon dioxide gas environment of a temperature as high as 200° C., and in which sufficient sulfide stress cracking resistance can be obtained even when the ambient temperature is low.

PTL 4 describes a stainless steel pipe for oil country tubular goods having high strength with a 0.2% proof stress of 758 MPa or more. The stainless steel pipe has a composition containing, in mass %, C: 0.05% or less, Si: 0.5% or less, Mn: 0.01 to 0.5%, P: 0.04% or less, S: 0.01% or less, Cr: more than 16.0% and 18.0% or less, Ni: more than 4.0% and 5.6% or less, Mo: 1.6 to 4.0%, Cu: 1.5 to 3.0%, Al: 0.001 to 0.10%, and N: 0.050% or less, in which Cr, Cu, Ni, and Mo satisfy a specific relation, and (C+N), Mn, Ni, Cu, and (Cr+Mo) satisfy a specific relation. The stainless steel pipe has a structure containing a martensite phase, and 10 to 40% ferrite phase in terms of a volume fraction, and in which the length from the surface is 50 μm in thickness direction, and the proportion of imaginary line segments that cross the ferrite phase is more than 85% in a plurality of imaginary line segments disposed side by side in a 10 μm-pitch within a range of 200 μm. In this way, PTL 4 allegedly enables provision of a stainless steel pipe for oil country tubular goods having improved corrosion resistance in a high-temperature environment of 150 to 250° C., and improved sulfide stress corrosion cracking resistance at ordinary temperature.

PTL 5 describes a high-strength stainless steel pipe for oil country tubular goods having high toughness, and improved corrosion resistance. The high-strength stainless steel pipe has a composition containing, in mass %, C: 0.04% or less, Si: 0.50% or less, Mn: 0.20 to 1.80%, P: 0.03% or less, S: 0.005% or less, Cr: 15.5 to 17.5%, Ni: 2.5 to 5.5%, V: 0.20% or less, Mo: 1.5 to 3.5%, W: 0.50 to 3.0%, Al: 0.05% or less, N: 0.15% or less, and O: 0.006% or less, in which Cr, Mo, W, and C satisfy a specific relation, and Cr, Mo, W, Si, C, Mn, Cu, Ni, and N satisfy a specific relation, and Mo and W satisfy a specific relation. The high-strength stainless steel pipe has a structure in which the distance between given two points within the largest crystal grain is 200 μm or less. In this way, PTL 5 allegedly enables provision of a high-strength stainless steel pipe for oil country tubular goods that achieves high strength with a yield strength of more than 654 MPa (95 ksi) and improved toughness, and that shows sufficient corrosion resistance in a $CO_2$—, $Cl^-$—, and $H_2S$-containing high-temperature corrosive environment of 170° C. or more.

PTL 6 describes a high-strength martensitic stainless steel seamless pipe for oil country tubular goods having a composition containing, in mass %, C: 0.01% or less, Si: 0.5% or less, Mn: 0.1 to 2.0%, P: 0.03% or less, S: 0.005% or less, Cr: more than 15.5% and 17.5% or less, Ni: 2.5 to 5.5%, Mo: 1.8 to 3.5%, Cu: 0.3 to 3.5%, V: 0.20% or less, Al: 0.05% or less, and N: 0.06% or less. The high-strength martensitic stainless steel seamless pipe has a structure that contains preferably at least 15% ferrite phase, and at most 25% residual austenite phase in terms of a volume fraction, and the balance is a tempered martensite phase. It is stated in PTL 6 that the composition may additionally contain W: 0.25 to 2.0%, and/or Nb: 0.20% or less. In this way, PTL 6 allegedly enables stable provision of a high-strength martensitic stainless steel seamless pipe for oil country tubular goods having high strength and a tensile characteristic with a yield strength of 655 MPa to 862 MPa, and a yield ratio of 0.90 or more, and sufficient corrosion resistance (carbon dioxide corrosion resistance, sulfide stress corrosion cracking resistance) even in a severe, high-temperature corrosive environment of 170° C. or more containing $CO_2$ and $Cl^-$, and $H_2S$.

PTL 7 describes a stainless steel pipe for oil country tubular goods having a composition containing, in mass %, C: 0.05% or less, Si: 1.0% or less, Mn: 0.01 to 1.0%, P: 0.05% or less, S: 0.002% or less, Cr: 16 to 18%, Mo: 1.8 to 3%, Cu: 1.0 to 3.5%, Ni: 3.0 to 5.5%, Co: 0.01 to 1.0%, Al: 0.001 to 0.1%, O: 0.05% or less, and N: 0.05% or less, in which Cr, Ni, Mo, and Cu satisfy a specific relation, and Cr, Ni, Mo, and Cu/3 satisfy a specific relation. The stainless steel pipe has a structure that contains preferably 10% or more and less than 60% ferrite phase, at most 10% residual austenite phase, and at least 40% martensite phase in terms of a volume fraction. In this way, PTL 7 allegedly enables provision of a stainless steel pipe for oil country tubular goods having high strength with a yield strength of 758 MPa or more, and high-temperature corrosion resistance.

PATENT LITERATURE

PTL 1: JP-A-2005-336595
PTL 2: JP-A-2008-81793
PTL 3: WO2010/050519
PTL 4: WO2010/134498
PTL 5: JP-A-2010-209402
PTL 6: JP-A-2012-149317
PTL 7: WO2013/146046

SUMMARY OF THE INVENTION

Recent development of oil fields and gas fields in severe corrosive environments has created a demand for a steel pipe for oil country tubular goods that has high strength with a yield strength of 758 MPa (110 ksi) or more, and that can maintain low-temperature toughness, and corrosion resistance. As used herein, "corrosion resistance" means having excellent carbon dioxide corrosion resistance, excellent sulfide stress corrosion cracking resistance (SCC resistance), and excellent sulfide stress cracking resistance (SSC resistance) particularly in a $CO_2$—, $Cl^-$—, and $H_2S$-containing severe high-temperature corrosive environment of 200° C. or more.

In the techniques described in PTL 1 to PTL 7, a large amount of alloy elements is contained in addition to the 17% Cr base to improve corrosion resistance. However, such a composition produces a final product that has a three-phase structure of ferrite, martensite, and austenite, and, because the composition contains the ferrite phase, which is deteriorated in low-temperature brittleness, the low-temperature toughness tends to deteriorate.

There are attempts to overcome the problem of the 17% Cr stainless steel. For example, attempts are made to (1) create a fine ferrite phase by low-temperature hot rolling, (2) increase the fraction of the austenite phase, which increases low-temperature toughness value, and (3) incorporate a phase having the pinning effect that inhibits coarsening of the grain growth of the ferrite phase. However, the measure (1) including the low-temperature hot rolling is problematic in that it causes rolling defects. The measures (2) and (3) are problematic in that control of the phase fraction is difficult to achieve in actual production.

In light of these problems, it is an object according to aspects of the present invention to provide a high strength seamless stainless steel pipe having high strength with a yield strength of 758 MPa or more, and excellent low-temperature toughness, and excellent corrosion resistance, preferred for use in oil well and gas well applications such as in crude oil wells and natural gas wells. Aspects of the present invention are also intended to provide a method for producing such a high strength seamless stainless steel pipe.

As used herein, "high-strength" means a yield strength of 758 MPa (110 ksi) or more. The yield strength is determined by a tensile test, which is conducted with an axial direction of pipe as a tensile direction according to the API 5CT specifications, as will be described later in Examples.

As used herein, "excellent low-temperature toughness" means strength with an absorption energy $vE_{-10}$ of 80 J or more as measured by a Charpy impact test at a test temperature of −10° C. The absorption energy of the Charpy impact test is determined as the arithmetic mean value of three test pieces measured in a Charpy impact test conducted according to the JIS Z 2242 specifications using a V-notch test piece (10-mm thick) collected in such an orientation that its longitudinal direction becomes the axial direction of a pipe, as will be described later in Examples.

As used herein, "excellent corrosion resistance" means having "excellent carbon dioxide corrosion resistance", "excellent sulfide stress corrosion cracking resistance", and "excellent sulfide stress cracking resistance". As used herein, "excellent carbon dioxide corrosion resistance" means that a test piece dipped in a test solution (a 20 mass % NaCl aqueous solution; liquid temperature: 200° C.; 30-atm $CO_2$ gas atmosphere) charged into an autoclave has a corrosion rate of 0.125 mm/γ or less after 336 hours in the solution. As used herein, "excellent sulfide stress corrosion cracking resistance" means that a test piece dipped in a test solution (a 20 mass % NaCl aqueous solution; liquid temperature: 100° C.; a 30-atm $CO_2$ gas, and 0.1-atm $H_2S$ atmosphere) having an adjusted pH of 3.3 with addition of acetic acid and sodium acetate in an autoclave does not crack even after 720 hours in the solution under an applied stress equal to 100% of the yield stress. As used herein, "excellent sulfide stress cracking resistance" means that a test piece dipped in an aqueous test solution (a 20 mass % NaCl aqueous solution; liquid temperature: 25° C.; a 0.9-atm $CO_2$ gas, and 0.1-atm $H_2S$ atmosphere) having an adjusted pH of 3.5 with addition of acetic acid and sodium acetate in an autoclave does not crack even after 720 hours in the solution under an applied stress equal to 90% of the yield stress.

In order to achieve the foregoing objects, the present inventors conducted intensive studies of a 17% Cr stainless steel pipe of a higher Cr-content composition from the perspective of corrosion resistance, with regard to various factors that affect low-temperature toughness. As a result of the investigation, the present inventors have found that the low-temperature toughness can be improved by reducing the work-induced transformation of the residual austenite that occurs with deformation of a test piece in a Charpy test. The low-temperature toughness improves because the untransformed residual austenite has more excellent low-temperature toughness than the as-quenched martensite that occurs as a result of work-induced transformation of the residual austenite. The present inventors have found that the work-induced transformation of the residual austenite can be reduced by making the $Md_{30}$ point of the residual austenite phase below −10° C. This temperature, −10° C., is a temperature that is used in a wide range of low-temperature toughness evaluations of oil country tubular goods materials. That is, a stainless steel pipe would be applicable to almost any environment if it could achieve the desired low-temperature toughness at this temperature. The $Md_{30}$ point is a temperature at which 50% of the structure undergoes martensite transformation under 30% tensile deformation. That is, the $Md_{30}$ point is an index that indicates that, when it is smaller, the residual austenite phase is less likely to undergo work-induced martensite transformation.

The present inventors also investigated a 17% Cr stainless steel pipe with regard to various factors that affect the corrosion resistance under a severe, high-temperature corrosive environment containing $CO_2$, $Cl^-$, and $H_2S$ where the temperature reaches 200° C. or higher temperature. As a result of the investigation, the present inventors have found a composite structure that contains a tempered martensite phase as a primary phase, and 20 to 40% secondary ferrite phase, and at most 25% residual austenite phase in terms of a volume fraction. Such a structure was found to exhibit excellent carbon dioxide corrosion resistance, excellent sulfide stress corrosion cracking resistance, and excellent sulfide stress cracking resistance under a severe corrosive environment such as above.

Aspects of the present invention were completed on the basis of these findings, and are as follows.

[1] A high strength seamless stainless steel pipe of a composition comprising C: 0.012 to 0.05%, Si: 1.0% or less, Mn: 0.1 to 0.5%, P: 0.05% or less, S: 0.005% or less, Cr: more than 16.0% and 18.0% or less, Mo: more than 2.0% and 3.0% or less, Cu: 0.5 to 3.5%, Ni: 3.0% or more and less than 5.0%, W: 0.01 to 3.0%, Nb: 0.01 to 0.5%, Al: 0.001 to 0.1%, N: 0.012 to 0.07%, O: 0.01% or less, and the balance being Fe and unavoidable impurities, the high strength seamless stainless steel pipe having a structure that includes a tempered martensite phase as a primary phase, and 20 to 40% ferrite phase, and at most 25% residual austenite phase in terms of a volume fraction, and in which C, Cr, Ni, Mo, N, W, and Cu in the residual austenite phase satisfy the following formula (1).

$$Md_{30}=1148-1775C-44Cr-39Ni-37Mo-698N-15W-13Cu\leq-10. \quad \text{Formula (1)}$$

In the formula (1), C, Cr, Ni, Mo, N, W, and Cu represent the content of each element in the residual austenite phase in mass % (the content being 0 (zero) for elements that are not contained).

[2] The high strength seamless stainless steel pipe according to item [1], wherein the composition further comprises, in mass %, at least one selected from Ti: 0.3% or less, V: 0.5% or less, Zr: 0.2% or less, Co: 1.4% or less, Ta: 0.1% or less, and B: 0.0100% or less.

[3] The high strength seamless stainless steel pipe according to item [1] or [2], wherein the composition further comprises, in mass %, at least one selected from Ca: 0.0005 to 0.0050%, and REM: 0.001 to 0.01%.

[4] A method for producing a high strength seamless stainless steel pipe from a steel pipe material of a composition containing, in mass %, C: 0.012 to 0.05%, Si: 1.0% or less, Mn: 0.1 to 0.5%, P: 0.05% or less, S: 0.005% or less, Cr: more than 16.0% and 18.0% or less, Mo: more than 2.0% and 3.0% or less, Cu: 0.5 to 3.5%, Ni: 3.0% or more and less than 5.0%, W: 0.01 to 3.0%, Nb: 0.01 to 0.5%, Al: 0.001 to 0.1%, N: 0.012 to 0.07%, O: 0.01% or less, and the balance Fe and unavoidable impurities, the method comprising:

heating the steel pipe material at a heating temperature of 1,100 to 1,300° C., and forming a seamless steel pipe of a predetermined shape by hot working;

heating the seamless steel pipe to a quenching temperature of 850 to 1,150° C. after the hot working;

quenching the seamless steel pipe by cooling the seamless steel pipe at an average cooling rate of 0.05° C./s or more to a cooling stop temperature at which the seamless steel pipe has a surface temperature of 50° C. or less and more than 0° C.;

subjecting the seamless steel pipe to an austenite stabilizing heat treatment in which the seamless steel pipe is heated to a temperature of 200 to 500° C., and air cooled; and tempering the seamless steel pipe by heating the seamless steel pipe to a tempering temperature of 500 to 650° C.

[5] The method for producing a high strength seamless stainless steel pipe according to item [4], wherein the composition further contains, in mass %, at least one selected from Ti: 0.3% or less, V: 0.5% or less, Zr: 0.2% or less, Co: 1.4% or less, Ta: 0.1% or less, and B: 0.0100% or less.

[6] The method for producing a high strength seamless stainless steel pipe according to item [4] or [5], wherein the composition further contains, in mass %, at least one selected from Ca: 0.0005 to 0.0050%, and REM: 0.001 to 0.01%.

Aspects of the present invention can provide a high strength seamless stainless steel pipe having high strength with a yield strength YS of 758 MPa or more, and excellent low-temperature toughness. The high strength seamless stainless steel pipe also has excellent carbon dioxide corrosion resistance, excellent sulfide stress corrosion cracking resistance, and excellent sulfide stress cracking resistance even in a severe corrosive environment containing $CO_2$, $Cl^-$, and $H_2S$. The high strength seamless stainless steel pipe produced according to aspects of the present invention is applicable to a stainless steel seamless pipe for oil country tubular goods, and enables production of a stainless steel seamless pipe for oil country tubular goods at low cost. This makes aspects of the invention highly useful in industry.

DETAILED DESCRIPTION OF EMBODIMENTS OF THE INVENTION

Embodiments of the present invention are described below in detail.

The following first describes the composition of the high strength seamless stainless steel pipe according to aspects of the present invention, and the reasons for specifying the composition. In the following, "%" means percent by mass, unless otherwise specifically stated.

C: 0.012% to 0.05%

Carbon increases the strength of the martensitic stainless steel. Carbon is also an important element that diffuses in the residual austenite phase in an austenite stabilizing heat treatment (described later), and improves the stability of the residual austenite phase. Carbon needs to be contained in an amount of 0.012% or more to achieve high strength with a yield strength of 758 MPa or more, and low-temperature toughness with a $vE_{-10}$ of 80 J or more. However, a carbon content of more than 0.05% causes excess precipitation of carbides in a heat treatment, and the corrosion resistance deteriorates. For this reason, the C content is 0.05% or less. That is, the C content is 0.012% to 0.05%. The C content is preferably 0.04% or less, more preferably 0.03% or less. The C content is preferably 0.015% or more, more preferably 0.020% or more.

Si: 1.0% or Less

Silicon is an element that acts as a deoxidizing agent. Desirably, silicon is contained in an amount of 0.005% or more to obtain this effect. A high Si content of more than 1.0% deteriorates hot workability, and corrosion resistance. For this reason, the Si content is 1.0% or less. The Si content is preferably 0.8% or less, more preferably 0.6% or less, further preferably 0.4% or less. The lower limit of Si content is not particularly limited, and the Si content is preferably 0.005% or more, more preferably 0.1% or more.

Mn: 0.1 to 0.5%

Manganese is an element that increases the strength of the martensitic stainless steel. Manganese needs to be contained in an amount of 0.1% or more to secure the strength desired in accordance with aspects of the present invention. A Mn content of more than 0.5% deteriorates low-temperature toughness. For this reason, the Mn content is 0.1 to 0.5%. The Mn content is preferably 0.4% or less, further preferably 0.3% or less. The Mn content is preferably 0.15% or more, more preferably 0.20% or more.

P: 0.05% or Less

Phosphorus is an element that deteriorates corrosion resistance, including carbon dioxide corrosion resistance, and sulfide stress cracking resistance. Preferably, phosphorus is contained in as small an amount as possible in accordance with aspects of the present invention. However, a P content of 0.05% or less is acceptable. For this reason, the P content is 0.05% or less. The P content is preferably 0.04% or less, more preferably 0.03% or less, further preferably 0.02% or less. The lower limit of P content is not particularly limited, and the P content is preferably 0.002% or more.

S: 0.005% or Less

Sulfur is an element that seriously deteriorates hot workability, and interferes with stable operation of hot working in pipe production. Sulfur should be contained in as small an amount as possible in accordance with aspects of the present invention. However, pipe production using ordinary processes is possible when the S content is 0.005% or less. Sulfur exists as sulfide inclusions in the steel, and deteriorates corrosion resistance. For this reason, the S content is 0.005% or less. The S content is preferably 0.003% or less, more preferably 0.002% or less. The lower limit of S content is not particularly limited, and the S content is preferably 0.0002% or more.

Cr: More than 16.0% and 18.0% or Less

Chromium forms a protective coating, and contributes to improving corrosion resistance. Chromium is also an element that improves the stability of the residual austenite phase. Chromium needs to be contained in an amount of more than 16.0% to obtain these effects. With a Cr content of more than 18.0%, the volume fraction of the ferrite phase becomes excessively high, and the desired high strength cannot be secured. For this reason, the Cr content is more than 16.0% and 18.0% or less. The Cr content is preferably 16.1% or more. The Cr content is preferably 17.5% or less. The Cr content is more preferably 16.2% or more. The Cr content is more preferably 17.0% or less.

Mo: More than 2.0% and 3.0% or Less

Molybdenum is an element that stabilizes the protective coating, and improves the sulfide stress cracking resistance and sulfide stress corrosion cracking resistance by improving the resistance against the pitting corrosion caused by $Cl^-$ and low pH. Molybdenum is also an element that improves the stability of the residual austenite phase. Molybdenum needs to be contained in an amount of more than 2.0% to obtain these effects. Molybdenum is an expensive element, and a Mo content of more than 3.0% increases the material cost. A Mo content of more than 3.0% also leads to deteriorated low-temperature toughness, and low sulfide stress corrosion cracking resistance. For this reason, the Mo content is more than 2.0% and 3.0% or less. The Mo content is preferably 2.1% or more. The Mo content is preferably 2.8% or less. The Mo content is more preferably 2.2% or more. The Mo content is more preferably 2.7% or less.

Cu: 0.5 to 3.5% or Less

Copper is an element that adds strength to the protective coating, reduces entry of hydrogen into the steel, and improves the sulfide stress cracking resistance and sulfide stress corrosion cracking resistance. Copper also improves the stability of the residual austenite phase. Copper needs to be contained in an amount of 0.5% or more to obtain these effects. A Cu content of more than 3.5% causes CuS to precipitate at the grain boundaries, and deteriorates hot workability. For this reason, the Cu content is 0.5 to 3.5%. The Cu content is preferably 0.7% or more. The Cu content is preferably 3.0% or less. The Cu content is more preferably 0.8% or more. The Cu content is more preferably 2.8% or less.

Ni: 3.0% or More and Less than 5.0%

Nickel is an element that adds strength to the protective coating, and contributes to improving the corrosion resistance. Nickel is also an element that increases steel strength by solid solution hardening. Nickel also improves the stability of the residual austenite phase. These effects become more pronounced when nickel is contained in an amount of 3.0% or more. A Ni content of 5.0% or more deteriorates the stability of the martensite phase, and this leads to deteriorated strength. For this reason, the Ni content is 3.0% or more and less than 5.0%. The Ni content is preferably 3.5% or more. The Ni content is preferably 4.5% or less. The Ni content is more preferably 3.7% or more. The Ni content is more preferably 4.3% or less.

W: 0.01 to 3.0%

Tungsten contributes to improving steel strength. In addition, tungsten is an element that stabilizes the protective coating, and improves the sulfide stress cracking resistance and sulfide stress corrosion cracking resistance. This makes tungsten an important element in accordance with aspects of the present invention. When contained with molybdenum, tungsten greatly improves, particularly sulfide stress cracking resistance. Tungsten is also an element that improves the stability of the residual austenite phase. Tungsten needs to be contained in an amount of 0.01% or more to obtain these effects. A high W content in excess of 3.0% deteriorates low-temperature toughness. For this reason, the W content is 0.01 to 3.0%. The W content is preferably 0.5% or more. The W content is preferably 2.0% or less. The W content is more preferably 0.8% or more. The W content is more preferably 1.3% or less.

Nb: 0.01 to 0.5%

Niobium precipitates as niobium carbonitride (Nb precipitate) by binding to carbon and nitrogen, and contributes to improving yield strength YS. This makes niobium an important element in accordance with aspects of the present invention. Niobium needs to be contained in an amount of 0.01% or more to obtain these effects. When niobium is contained in an amount of more than 0.5%, carbon and nitrogen, which contribute to stabilizing the residual austenite phase, become fixed in the form of a carbonitride, and the residual austenite phase becomes unstable. A Nb content of more than 0.5% leads to deteriorated low-temperature toughness, and deteriorated sulfide stress cracking resistance. For this reason, the Nb content is 0.01 to 0.5%. The Nb content is preferably 0.05% or more. The Nb content is preferably 0.2% or less. The Nb content is more preferably 0.07% or more. The Nb content is more preferably 0.15% or less.

Al: 0.001 to 0.1%

Aluminum is an element that acts as a deoxidizing agent. Aluminum needs to be contained in an amount of 0.001% or more to obtain this effect. When contained in excess of 0.1%, an amount of aluminum oxide increases, and deteriorates cleanliness and low-temperature toughness. For this reason, the Al content is 0.001 to 0.1%. The Al content is preferably 0.01% or more. The Al content is preferably 0.07% or less. The Al content is more preferably 0.02% or more. The Al content is more preferably 0.04% or less.

N: 0.012 to 0.07%

Nitrogen improves the pitting corrosion resistance. Nitrogen is also an important element that diffuses in the residual austenite phase in the austenite stabilizing heat treatment, and improves the stability of the residual austenite phase. Nitrogen needs to be contained in an amount of 0.012% or more to obtain this effect. When contained in an amount of 0.07% or more, nitrogen forms a nitride, and deteriorates low-temperature toughness. For this reason, the N content is 0.012 to 0.07%. The N content is preferably 0.02% or more. The N content is preferably 0.06% or less. The N content is more preferably 0.03% or more. The N content is more preferably 0.055% or less.

O: 0.01% or Less

Oxygen (O) exists as an oxide in the steel, and has adverse effect on various characteristics. It is accordingly desirable in accordance with aspects of the present invention to reduce the O content as much as possible. Particularly, an O content of more than 0.01% deteriorates hot workability, corrosion resistance, and low-temperature toughness. For this reason, the O content is 0.01% or less. The O content is preferably 0.006% or less, more preferably 0.003% or less.

The balance is Fe and unavoidable impurities.

The foregoing components represent the basic components, and the high strength seamless stainless steel pipe according to aspects of the present invention can exhibit the intended characteristics with these basic components. In addition to the basic components described above, the following selectable elements may be contained in accordance with aspects of the present invention, as needed.

At Least One Selected from Ti: 0.3% or Less, V: 0.5% or Less, Zr: 0.2% or Less, Co: 1.4% or Less, Ta: 0.1% or Less, and B: 0.0100% or Less Ti, V, Zr, Co, Ta, and B are all useful as elements that increase the strength, and one or more of these elements may be selected and contained, as needed. In addition to this effect, Ti, V, Zr, Co, Ta, and B also have the effect to improve the sulfide stress cracking resistance. In order to obtain these effects, it is desirable to contain at least one selected from Ti: 0.001% or more, V: 0.01% or more, Zr: 0.01% or more, Co: 0.01% or more, Ta: 0.01% or more, and B: 0.0003% or more. Low-temperature toughness deteriorates when Ti, V, Zr, Co, Ta, and B are contained in excess of 0.3%, 0.5%, 0.2%, 1.4%, 0.1%, and 0.0100%, respectively. For this reason, when Ti, V, Zr, Co, Ta, and B are contained, the Ti, V, Zr, Co, Ta, and B contents are preferably Ti: 0.3% or less, V: 0.5% or less, Zr: 0.2% or less, Co: 1.4% or less, Ta: 0.1% or less, and B: 0.0100% or less. The Ti, V, Zr, Co, Ta, and B contents are more preferably Ti: 0.1% or less, V: 0.1% or less, Zr: 0.1% or less, Co: 0.1% or less, Ta: 0.05% or less, and B: 0.0050% or less. The Ti, V, Zr, Co, Ta, and B contents are more preferably Ti: 0.003% or more, V: 0.03% or more, Zr: 0.03% or more, Co: 0.06% or more, Ta: 0.03% or more, and B: 0.0010% or more.

At Least One Selected from Ca: 0.0005 to 0.0050%, and REM: 0.001 to 0.01%

Ca, and REM (rare-earth metals) are useful as elements that contributes to improving sulfide stress corrosion cracking resistance via controlling the shape of sulfides, and one or more of these elements may be contained, as needed. In order to obtain this effect, it is desirable to contain one or more selected from Ca: 0.0005% or more, and REM: 0.001% or more. The effect becomes saturated when Ca and REM are contained in excess of 0.0050% and 0.01%, respectively, and such excess contents are not expected to produce corresponding effects. For this reason, when Ca and REM are contained, the Ca and REM contents are preferably Ca: 0.0005 to 0.0050%, and REM: 0.001 to 0.01%. More preferably, the Ca and REM contents are Ca: 0.0020 to 0.0040%, and REM: 0.002 to 0.009%.

The following describes the structure of the high strength seamless stainless steel pipe according to aspects of the present invention, and the reasons for limiting the structure. In the following, "volume fraction" means a volume fraction with respect to the total steel sheet structure.

In addition to the composition described above, the high strength seamless stainless steel pipe according to aspects of the present invention has a composite structure that includes a tempered martensite phase as a primary phase, and 20 to 40% ferrite phase, and at most 25% residual austenite phase in terms of a volume fraction. As used herein, "primary phase" refers to a phase that occupies more than 40% of the total structure in terms of a volume fraction. In accordance with aspects of the present invention, C, Cr, Ni, Mo, N, W, and Cu in the residual austenite phase have a structure that satisfies the formula (1) described below.

The high-strength seamless stainless steel pipe according to aspects of the present invention includes a tempered martensite phase as a primary phase so that the high strength desired in accordance with aspects of the present invention can be secured.

In accordance with aspects of the present invention, at least the ferrite phase is precipitated as a secondary phase in an amount of 20% or more in terms of a volume fraction. In this way, propagation of corrosion cracking can be suppressed, and the desired corrosion resistance (carbon dioxide corrosion resistance, sulfide stress corrosion cracking resistance, and sulfide stress cracking resistance) can be secured. When the ferrite phase precipitates in amounts in excess of 40%, the strength deteriorates, and the desired high strength cannot be secured. Such excess precipitation also deteriorates sulfide stress corrosion cracking resistance, and sulfide stress cracking resistance. For this reason, the volume fraction of the ferrite phase is 20 to 40%. The volume fraction of the ferrite phase is preferably 23% or more. Preferably, the volume fraction of the ferrite phase is 35% or less.

In addition to the secondary ferrite phase, the residual austenite phase is precipitated as a third phase in a volume fraction of 25% or less in accordance with aspects of the present invention. Ductility and low-temperature toughness improve with the presence of the residual austenite phase. In order to obtain this effect, it is desirable to precipitate the residual austenite phase in a volume fraction of 5% or more. The desired high strength cannot be secured when the residual austenite phase precipitates in a volume fraction in excess of 25%. For this reason, the volume fraction of the residual austenite phase is 25% or less. The volume fraction of the residual austenite phase is preferably 5% or more. Preferably, the volume fraction of the residual austenite phase is 20% or less. The volume fractions of the tempered martensite phase, the austenite phase, and the ferrite phase can be measured using the method described in the Examples below.

In the high strength seamless stainless steel pipe according to aspects of the present invention, the elements contained in the residual austenite phase need to satisfy the following formula (1). In this way, the work-induced transformation of the residual austenite phase due to deformation of a test piece in a Charpy test can be reduced, and excellent low-temperature toughness can be obtained.

$$Md_{30}=1148-1775C-44Cr-39Ni-37Mo-698N-15W-13Cu\leq-10. \quad \text{Formula (1)}$$

In the formula (1), C, Cr, Ni, Mo, N, W, and Cu represent the content of each element in the residual austenite phase in mass % (the content being 0 (zero) for elements that are not contained).

The $Md_{30}$ point in formula (1) is a temperature at which 50% of the structure undergoes martensite transformation under 30% tensile deformation. That is, the $Md_{30}$ point is an index that indicates that, when it is smaller, the residual austenite phase is less likely to undergo work-induced martensite transformation. The coefficients in formula (1) are coefficients that were newly determined by the present inventors. When the value of formula (1) increases above −10.0 (° C.), the amount of as-quenched martensite that occurs as a result of work-induced transformation of the residual austenite increases, and the intended low-temperature toughness according to aspects of the present invention cannot be secured. The $Md_{30}$ value in formula (1) is preferably −14.0° C. or less.

The elements in the residual austenite phase were determined by using the method described in the Examples below. For example, a test piece for structure observation is collected in such an orientation that a cross section along the axial direction of pipe becomes the observation surface. The residual austenite is identified by EBSP (Electron Back Scattering Pattern) analysis, and the identified phase of each sample is measured at 20 points using an FE-EPMA (Field Emission Electron Probe Micro Analyzer). The mean value of values quantified for the chemical composition obtained is then used as the chemical composition of the residual austenite phase in the steel.

A method for producing the high strength seamless stainless steel pipe according to aspects of the present invention is described below.

A method for producing the high strength seamless stainless steel pipe according to aspects of the present invention includes a heating step of heating a steel pipe material, a hot working step of forming a seamless steel pipe by hot working the steel pipe material heated in the heating step, a cooling step of cooling the steel seamless pipe obtained in the hot working step, and a heat treatment step of quenching the steel seamless pipe cooled in the cooling step, subjecting the steel seamless pipe to an austenite stabilizing heat treatment, and tempering the steel seamless pipe.

In accordance with aspects of the present invention, a steel pipe material of the composition described above is used as a starting material. The method of production of the steel pipe material does not need to be particularly limited, and any known steel pipe material producing method may be used. The steel pipe material producing method is preferably one in which, for example, a molten steel of the foregoing composition is made into steel using an ordinary steel making process such as by using a converter, and formed into a cast piece (steel pipe material), for example, a billet, using a method such as continuous casting, and ingot casting-breakdown rolling. However, the steel pipe material producing method is not limited to this. The cast piece may be further subjected to hot rolling to make a steel piece of the desired dimensions and shape, and used as a steel pipe material.

The steel pipe material so obtained is heated, and hot worked using a process of hot manufacturing a pipe, for example, such as the Mannesmann-plug mill process, or the Mannesmann-mandrel mill process to produce a seamless steel pipe of the foregoing composition in the desired dimensions. The hot working for the production of the steel seamless pipe may be hot extrusion by pressing.

The heating temperature T (° C.) of the heating step is 1,100 to 1,300° C. With a heating temperature T of less than 1,100° C., hot workability deteriorates, and defects occur during the pipe production. With a high heating temperature T of more than 1,300° C., a single ferrite phase occurs, and the crystal grains coarsen. This leads to deteriorated low-temperature toughness even after the quenching described later. For this reason, the heating temperature T is 1,100 to 1,300° C. Preferably, the heating temperature T is 1,210 to 1,290° C.

The heating time in the heating step is not particularly limited, and is preferably, for example, 15 minutes to 2 hours from a productivity standpoint. The heating time in the heating step is more preferably 30 minutes to 1 hour.

The hot working conditions in the hot working step are not particularly limited, as long as a steel seamless pipe of the desired dimensions can be produced, and any ordinary manufacturing conditions are applicable.

The hot-worked steel seamless pipe is cooled in the cooling step. The cooling conditions in the cooling step do not need to be particularly limited. The hot-worked steel seamless pipe can have a structure with a primary martensite phase when cooled to room temperature at an average cooling rate that is about the same as the rate of air cooling after the hot working, provided that the composition falls in the range according to aspects of the present invention.

In accordance with aspects of the present invention, the cooling step is followed by the heat treatment step, which includes quenching, an austenite stabilizing heat treatment, and tempering.

In the quenching process, the steel seamless pipe cooled in the cooling step is heated to a quenching temperature in a heating temperature range of 850 to 1,150° C., and cooled to a cooling stop temperature at which the seamless steel pipe has a surface temperature of 50° C. or less and more than 0° C. The cooling in the quenching process proceeds at an average cooling rate as fast as or faster than air cooling, preferably 0.05° C./s or more.

When the heating temperature of the quenching process (quenching temperature) is less than 850° C., reverse transformation of martensite to austenite does not easily occur, and the austenite does not easily transform into martensite during the temperature drop from the quenching temperature to the cooling stop temperature in the cooling process. In this case, the desired high strength may not be secured. With a high quenching temperature of more than 1,150° C., the crystal grains easily coarsen, and the low-temperature toughness may deteriorate. For this reason, the quenching temperature is 850 to 1,150° C., more preferably 900 to 1,000° C. In accordance with aspects of the present invention, the holding time in the quenching process is preferably at least 5 minutes from the viewpoint of making the temperature inside the material uniform. The desired uniform structure may not be obtained when the holding time in the quenching process is less than 5 minutes. More preferably, the holding time in the quenching process is at least 10 minutes. The holding time in the quenching process is preferably at most 210 minutes.

When the average cooling rate of quenching is less than 0.05° C./s, coarse carbonitrides and intermetallic compounds precipitate, and the low-temperature toughness and the corrosion resistance seriously deteriorate. The upper limit of average cooling rate does not need to be particularly limited. As used herein, "average cooling rate" means the average rate of cooling from the quenching temperature to the cooling stop temperature of quenching. When the cooling stop temperature of quenching is more than 50° C., the amount of martensite, which contributes to strength, becomes smaller, and the strength seriously deteriorates. For this reason, the cooling stop temperature of quenching is 50° C. or less, more preferably 40° C. or less and more than 0° C.

In accordance with aspects of the present invention, the volume fraction of the ferrite phase can be more easily adjusted within the appropriate range when the heating temperature of quenching falls in the foregoing ranges. The volume of the residual austenite phase cannot be easily adjusted within the appropriate range when the cooling stop temperature of quenching is too low.

The austenite stabilizing heat treatment is a very important step in accordance with aspects of the present invention. The austenite stabilizing heat treatment is a process in which the quenched steel seamless pipe is heated to a temperature of 200 to 500° C., and cooled.

With the austenite stabilizing heat treatment, carbon and nitrogen, which are austenite generating elements in the quenched martensite and having large diffusion coefficients, diffuse in the residual austenite. This lowers the $Md_{30}$ point in the residual austenite, and the low-temperature toughness improves. When the heating temperature in the austenite stabilizing heat treatment is less than 200° C., diffusion of carbon and nitrogen in the residual austenite becomes insufficient, and the desired low-temperature toughness cannot be obtained. When the heating temperature of the austenite stabilizing heat treatment is 500° C. or more, carbon and nitrogen precipitate as a carbonitride, and the effective amounts of carbon and nitrogen needed to stabilize the residual austenite become smaller. In this case, the desired low-temperature toughness cannot be obtained. For this reason, the heating temperature of the austenite stabilizing heat treatment is 200 to 500° C. Preferably, the heating temperature of the austenite stabilizing heat treatment is 250 to 450° C.

In accordance with aspects of the present invention, the holding time in the austenite stabilizing heat treatment is preferably at least 5 minutes from the viewpoint of making the temperature inside the material uniform. The desired uniform structure cannot be obtained when the holding time in the austenite stabilizing heat treatment is less than 5 minutes. The holding time in the austenite stabilizing heat treatment is more preferably at least 20 minutes. The holding time in the austenite stabilizing heat treatment is preferably at most 210 minutes. As used herein, cooling in the austenite stabilizing heat treatment means cooling from a temperature range of 200 to 500° C. to room temperature at an average cooling rate of air cooling or faster. Preferably, the average cooling rate in the austenite stabilizing heat treatment is 0.05° C./s or more.

The tempering is a process in which the steel seamless pipe after the austenite stabilizing treatment is heated to a tempering temperature in a heating temperature range of 500 to 650° C., and cooled.

When the heating temperature of the tempering process (tempering temperature) is less than 500° C., the tempering effect may not be obtained as intended because a tempering temperature in this temperature range is too low. A high tempering temperature of more than 650° C. produces an as-quenched martensite phase, and it may not be possible to provide the desired high strength, low-temperature toughness, and excellent corrosion resistance. For this reason, the tempering temperature is 500 to 650° C. Preferably, the tempering temperature is 550 to 630° C. In accordance with aspects of the present invention, the holding time in the tempering process is preferably at least 5 minutes from the viewpoint of making the temperature inside the material uniform. The desired uniform structure cannot be obtained when the holding time in the tempering process is less than 5 minutes. The holding time in the tempering process is more preferably at least 20 minutes. Preferably, the holding time in the tempering process is at most 210 minutes. As used herein, cooling in the tempering process means cooling from the tempering temperature to room temperature at an average cooling rate of air cooling or faster. Preferably, the average cooling rate in the tempering process is 0.05° C./s or more.

In accordance with aspects of the present invention, the steel seamless pipe after the heat treatment (quenching, austenite stabilizing heat treatment, and tempering) has a composite structure including the primary tempered martensite phase, the ferrite phase, and the residual austenite phase.

Aspects of the present invention can thus provide a high strength seamless stainless steel pipe having the desired high strength, low-temperature toughness, and excellent corrosion resistance.

EXAMPLES

Aspects of the present invention are described below with reference to Examples. It should be noted that the present invention is not limited to the Examples below.

In Examples, molten steels of the compositions shown in Tables 1 and 2 were made into steel with a converter furnace, and cast into billets (cast piece; steel pipe material) by continuous casting. The resulting steel pipe materials (cast pieces) were then heated in the heating step at the heating temperatures T shown in Tables 3 and 4. The holding times at these heating temperatures T are as shown in Tables 3 and 4.

The steel pipe material heated in the heating step was hot worked (hot working) with a model seamless rolling machine to produce a seamless steel pipe (outer diameter $\phi$=83.8 mm×wall thickness=12.7 mm). After hot working, the seamless steel pipe was air cooled.

The seamless steel pipe was then cut into a test piece material. The test piece material was heated under the conditions shown in Tables 3 and 4, and water cooled in a quenching process. This was followed by an austenite stabilizing heat treatment in which the test piece material was heated under the conditions shown in Tables 3 and 4, and air cooled. The test piece material was then tempered by being heated under the conditions shown in Tables 3 and 4, and air cooled. That is, the test piece material after these processes corresponds to a seamless steel pipe that has been subjected to quenching, an austenite stabilizing heat treatment, and tempering.

A test piece for structure observation was collected from the obtained test piece material, and subjected to structure observation, a quantitative evaluation of the composition of the residual austenite phase. The test piece was also tested by a tensile test, a Charpy impact test, and a corrosion resistance test. The corrosion resistance was tested by conducting a corrosion test, a sulfide stress corrosion cracking resistance test (SCC resistance test), and a sulfide stress cracking resistance test (SSC resistance test). The tests were conducted in the manner described below.

(1) Structure Observation

A test piece for structure observation was collected from the obtained test piece material in such an orientation that a cross section along the axial direction of the pipe became the observed surface.

The volume fraction of the ferrite phase was determined by observing the surface with a scanning electron microscope. The test piece for structure observation was corroded with a Vilella's solution (a mixed reagent containing 100 ml of ethanol, 10 ml of hydrochloric acid, and 2 g of picric acid). The structure was imaged with a scanning electron microscope (magnification: 1,000 times), and the mean value of the area percentage of the ferrite phase was calculated with an image analyzer, and used as the volume fraction (%).

The volume fraction of the residual austenite phase was measured by the X-ray diffraction method. A test piece for X-ray diffraction was collected from the test piece material in such an orientation that a cross section (cross section C) orthogonal to the axial direction of the pipe became the measurement surface. By X-ray diffraction, the diffraction X-ray integral intensity was measured for the (220) plane of the residual austenite phase ($\gamma$), and the (211) plane of the ferrite phase ($\alpha$). The volume fraction of the residual austenite phase was converted using the following equation.

$$\gamma(\text{Volume fraction})=100/(1+(I\alpha R\gamma/I\gamma R\alpha))$$

In the equation, $I\alpha$ represents the integral intensity of $\alpha$, $R\alpha$ represents a crystallographic theoretical value for $\alpha$, $I\gamma$ represents the integral intensity of $\gamma$, and $R\gamma$ represents a crystallographic theoretical value for $\gamma$.

The volume fraction of the martensite phase was calculated as the remainder other than these phases.

(2) Quantitative Evaluation of the Composition in Residual Austenite Phase

The same test piece used for the structure observation was used to identify the residual austenite by EBSP (Electron Back Scattering Pattern) analysis. The phase identified as the residual austenite was measured at 20 points for each sample using an FE-EPMA (Field Emission Electron Probe Micro Analyzer), and the average quantitative value of the chemical composition was used as the chemical composition of the residual austenite phase in the steel. The chemical composition is presented in Tables 5 and 6.

(3) Tensile Characteristics

A strip specimen specified by API standard 5CT was collected from the test piece material in such an orientation that the tensile direction was in the axial direction of the pipe. The strip specimen was then subjected to a tensile test according to the API 5CT specifications to determine its tensile characteristics (yield strength YS, tensile strength TS). Here, "API" stands for American Petroleum Institute. In accordance with aspects of the present invention, the test piece was evaluated as being acceptable when it had a yield strength of 758 MPa or more.

(4) Charpy Impact Test

A V-notch test piece (10-mm thick) was collected from the test piece material according to the JIS Z 2242 specifications. Here, the test piece was collected in such an orientation that the longitudinal direction of the test piece was in the axial direction of the pipe. The test was conducted at −10° C. and −40° C. The absorption energy $vE_{-10}$ at −10° C., and the absorption energy $vE_{-40}$ at −40° C. were determined, and the toughness was evaluated. Three test pieces were used at each temperature, and the arithmetic mean value of the obtained values was calculated as the absorption energy (J) of the high strength seamless stainless steel pipe. In accordance with aspects of the present invention, the test piece was evaluated as being acceptable when it had a $vE_{-10}$ of 80 J or more.

(5) Corrosion Test (Carbon Dioxide Corrosion Resistance Test)

A corrosion test piece, measuring 3 mm in wall thickness, 30 mm in width, and 40 mm in length, was machined from the test piece material, and subjected to a corrosion test to evaluate the carbon dioxide corrosion resistance.

The corrosion test was conducted by dipping the corrosion test piece for 14 days (336 hours) in a test solution (a 20 mass % NaCl aqueous solution; liquid temperature: 200° C., a 30-atm $CO_2$ gas atmosphere) charged into an autoclave. The mass of the corrosion test piece was measured before and after the test, and the corrosion rate was calculated from the mass difference. In accordance with aspects of the present invention, the test piece was evaluated as being acceptable when it had a corrosion rate of 0.125 mm/$\gamma$ or less.

(6) Sulfide Stress Cracking Resistance Test (SSC Resistance Test)

A round rod-shaped test piece (diameter $\phi$=6.4 mm) was machined from the test piece material according to NACE TM0177, Method A, and subjected to a sulfide stress cracking resistance test (SSC resistance test). Here, "NACE" stands for National Association of Corrosion Engineering.

In the SSC resistance test, the test piece was dipped in a test solution (a 20 mass % NaCl aqueous solution; liquid temperature: 25° C.; 0.1-atm; $H_2S$: 0.9-atm $CO_2$ atmosphere) charged into an autoclave and having an adjusted pH of 3.5 with addition of acetic acid and sodium acetate. The test piece was kept in the solution for 720 hours to apply a stress equal to 90% of the yield stress. After the test, the test piece was observed for the presence or absence of cracking. In accordance with aspects of the present invention, the test piece was evaluated as being acceptable when it did not have a crack after the test. In Tables 5 and 6, the "Absent" represents no cracking, and the "Present" represents cracking.

(7) Sulfide Stress Corrosion Cracking Resistance Test (SCC Resistance Test)

A 4-point bend test piece, measuring 3 mm in thickness, 15 mm in width, and 115 mm in length, was collected from the test piece material by machining, and subjected to a sulfide stress corrosion cracking resistance test (SCC resistance test) according to EFC17. Here, "EFC" stands for European Federal of Corrosion.

In the SCC resistance test, the test piece was dipped in a test solution (a 20 mass % NaCl aqueous solution; liquid temperature: 100° C.; 0.1-atm $H_2S$; 30-atm $CO_2$ atmosphere) charged into an autoclave and having an adjusted pH of 3.3 with addition of acetic acid and sodium acetate. The test piece was kept in the solution for 720 hours to apply a stress equal to 100% of the yield stress. After the test, the test piece was observed for the presence or absence of cracking. In accordance with aspects of the present invention, the test piece was evaluated as being acceptable when it did not have a crack after the test. In Tables 5 and 6, the "Absent" represents no cracking, and the "Present" represents cracking.

The results of these tests are presented in Tables 5 and 6.

TABLE 1

| Steel | Composition (mass %) | | | | | | | | | | | |
|---|---|---|---|---|---|---|---|---|---|---|---|---|
| type | C | Si | Mn | P | S | Cr | Ni | Mo | N | O | Al | Cu |
| A | 0.026 | 0.24 | 0.24 | 0.015 | 0.0008 | 17.0 | 4.1 | 2.72 | 0.046 | 0.0015 | 0.036 | 0.94 |
| B | 0.028 | 0.23 | 0.27 | 0.015 | 0.0008 | 16.3 | 4.1 | 2.67 | 0.046 | 0.0024 | 0.035 | 1.03 |
| C | 0.031 | 0.23 | 0.23 | 0.019 | 0.0007 | 16.5 | 3.9 | 2.72 | 0.024 | 0.0015 | 0.034 | 0.88 |
| E | 0.022 | 0.26 | 0.22 | 0.013 | 0.0007 | 16.9 | 3.7 | 2.13 | 0.037 | 0.0018 | 0.042 | 0.90 |
| F | 0.011 | 0.29 | 0.26 | 0.010 | 0.0010 | 16.2 | 3.7 | 2.30 | 0.044 | 0.0030 | 0.011 | 0.90 |
| G | 0.022 | 0.26 | 0.30 | 0.014 | 0.0007 | 14.9 | 3.4 | 2.40 | 0.065 | 0.0024 | 0.053 | 3.80 |
| H | 0.019 | 0.30 | 0.32 | 0.016 | 0.0007 | 17.9 | 2.4 | 1.90 | 0.026 | 0.0025 | 0.043 | 0.20 |
| J | 0.027 | 0.23 | 0.26 | 0.015 | 0.0008 | 16.2 | 4.0 | 2.67 | 0.048 | 0.0024 | 0.036 | 1.03 |
| K | 0.025 | 0.25 | 0.22 | 0.015 | 0.0007 | 16.9 | 4.2 | 2.63 | 0.041 | 0.0014 | 0.038 | 0.97 |
| L | 0.030 | 0.23 | 0.26 | 0.015 | 0.0008 | 16.3 | 4.2 | 2.55 | 0.049 | 0.0027 | 0.033 | 1.06 |
| M | 0.022 | 0.25 | 0.30 | 0.015 | 0.0007 | 16.6 | 3.7 | 2.43 | 0.051 | 0.0022 | 0.043 | 2.66 |
| N | 0.026 | 0.24 | 0.31 | 0.014 | 0.0008 | 16.8 | 3.6 | 2.54 | 0.046 | 0.0018 | 0.045 | 2.54 |
| O | 0.025 | 0.24 | 0.31 | 0.014 | 0.0008 | 17.0 | 4.5 | 2.70 | 0.076 | 0.0037 | 0.045 | 3.20 |
| P | 0.029 | 0.24 | 0.31 | 0.014 | 0.0008 | 17.6 | 3.5 | 2.87 | 0.055 | 0.0041 | 0.043 | 1.38 |
| Q | 0.026 | 0.24 | 0.31 | 0.014 | 0.0008 | 17.5 | 4.8 | 2.66 | 0.034 | 0.0028 | 0.035 | 2.72 |
| R | 0.030 | 0.24 | 0.31 | 0.014 | 0.0008 | 16.5 | 4.3 | 2.36 | 0.053 | 0.0053 | 0.033 | 1.19 |
| S | 0.022 | 0.24 | 0.31 | 0.014 | 0.0008 | 17.3 | 4.0 | 2.38 | 0.044 | 0.0027 | 0.028 | 1.97 |
| T | 0.048 | 0.24 | 0.24 | 0.015 | 0.0008 | 17.0 | 4.1 | 2.72 | 0.046 | 0.0015 | 0.036 | 0.94 |
| U | 0.056 | 0.24 | 0.24 | 0.015 | 0.0008 | 17.0 | 4.1 | 2.72 | 0.046 | 0.0015 | 0.036 | 0.94 |
| V | 0.013 | 0.24 | 0.24 | 0.015 | 0.0008 | 17.0 | 4.1 | 2.72 | 0.046 | 0.0015 | 0.036 | 0.94 |
| W | 0.010 | 0.24 | 0.24 | 0.015 | 0.0008 | 17.0 | 4.1 | 2.72 | 0.046 | 0.0015 | 0.036 | 0.94 |
| X | 0.026 | 0.90 | 0.24 | 0.015 | 0.0008 | 17.0 | 4.1 | 2.72 | 0.046 | 0.0015 | 0.036 | 0.94 |
| Y | 0.026 | 1.10 | 0.24 | 0.015 | 0.0008 | 17.0 | 4.1 | 2.72 | 0.046 | 0.0015 | 0.036 | 0.94 |
| Z | 0.026 | 0.006 | 0.24 | 0.015 | 0.0008 | 17.0 | 4.1 | 2.72 | 0.046 | 0.0078 | 0.036 | 0.94 |
| AA | 0.026 | 0.004 | 0.24 | 0.015 | 0.0008 | 17.0 | 4.1 | 2.72 | 0.046 | 0.0112 | 0.036 | 0.94 |
| AB | 0.026 | 0.24 | 0.49 | 0.015 | 0.0008 | 17.0 | 4.1 | 2.72 | 0.046 | 0.0015 | 0.036 | 0.94 |
| AC | 0.026 | 0.24 | 0.57 | 0.015 | 0.0008 | 17.0 | 4.1 | 2.72 | 0.046 | 0.0015 | 0.036 | 0.94 |
| AD | 0.026 | 0.24 | 0.11 | 0.015 | 0.0008 | 17.0 | 4.1 | 2.72 | 0.046 | 0.0015 | 0.036 | 0.94 |
| AE | 0.026 | 0.24 | 0.09 | 0.015 | 0.0008 | 17.0 | 4.1 | 2.72 | 0.046 | 0.0015 | 0.036 | 0.94 |
| AF | 0.026 | 0.24 | 0.24 | 0.049 | 0.0008 | 17.0 | 4.1 | 2.72 | 0.046 | 0.0015 | 0.036 | 0.94 |
| AG | 0.026 | 0.24 | 0.24 | 0.057 | 0.0008 | 17.0 | 4.1 | 2.72 | 0.046 | 0.0015 | 0.036 | 0.94 |
| AH | 0.026 | 0.24 | 0.24 | 0.002 | 0.0008 | 17.0 | 4.1 | 2.72 | 0.046 | 0.0015 | 0.036 | 0.94 |
| AI | 0.026 | 0.24 | 0.24 | 0.015 | 0.0050 | 17.0 | 4.1 | 2.72 | 0.046 | 0.0015 | 0.036 | 0.94 |
| AJ | 0.026 | 0.24 | 0.24 | 0.015 | 0.0055 | 17.0 | 4.1 | 2.72 | 0.046 | 0.0015 | 0.036 | 0.94 |
| AK | 0.026 | 0.24 | 0.24 | 0.015 | 0.0002 | 17.0 | 4.1 | 2.72 | 0.046 | 0.0015 | 0.036 | 0.94 |

| Steel | Composition (mass %) | | | | | | | | | |
|---|---|---|---|---|---|---|---|---|---|---|
| type | W | Nb | V | Ta | Ti | B | Zr | Co | Ca | REM |
| A | 0.92 | 0.086 | 0.03 | — | — | — | — | — | — | — |
| B | 0.97 | 0.094 | 0.04 | 0.035 | 0.003 | 0.0019 | 0.037 | 0.066 | 0.0034 | 0.0086 |
| C | 1.04 | 0.089 | 0.04 | — | — | — | — | — | — | — |
| E | 1.09 | 0.066 | — | — | — | — | — | — | 0.0022 | — |
| F | 1.70 | 0.050 | 0.07 | — | — | — | — | — | — | — |
| G | 2.80 | 0.120 | 0.07 | — | — | — | — | — | — | — |
| H | 0.10 | 0.070 | 0.06 | — | — | — | — | — | — | — |
| J | 0.99 | 0.094 | 0.04 | — | — | — | — | — | 0.0034 | 0.0086 |
| K | 0.89 | 0.080 | 0.03 | — | — | — | — | — | — | — |
| L | 0.98 | 0.084 | 0.04 | — | 0.003 | 0.0015 | — | 0.065 | 0.0030 | 0.0083 |
| M | 1.15 | 0.094 | 0.06 | — | — | — | — | — | — | — |
| N | 1.16 | 0.076 | — | — | — | — | — | — | — | — |
| O | 0.53 | 0.029 | — | — | 0.15 | 0.0068 | — | — | — | — |

TABLE 1-continued

| | | | | | | | | | | |
|---|---|---|---|---|---|---|---|---|---|---|
| P | 0.80 | 0.302 | 0.30 | — | — | — | — | — | — | — |
| Q | 2.16 | 0.193 | — | — | — | — | 0.14 | 1.2 | — | — |
| R | 2.70 | 0.153 | — | 0.08 | — | — | — | — | 0.0041 | — |
| S | 0.10 | 0.430 | — | — | — | — | — | — | — | 0.002 |
| T | 0.92 | 0.086 | — | — | — | — | — | — | — | — |
| U | 0.92 | 0.086 | — | — | — | — | — | — | — | — |
| V | 0.92 | 0.086 | — | — | — | — | — | — | — | — |
| W | 0.92 | 0.086 | — | — | — | — | — | — | — | — |
| X | 0.92 | 0.086 | — | — | — | — | — | — | — | — |
| Y | 0.92 | 0.086 | — | — | — | — | — | — | — | — |
| Z | 0.92 | 0.086 | — | — | — | — | — | — | — | — |
| AA | 0.92 | 0.086 | — | — | — | — | — | — | — | — |
| AB | 0.92 | 0.086 | — | — | — | — | — | — | — | — |
| AC | 0.92 | 0.086 | — | — | — | — | — | — | — | — |
| AD | 0.92 | 0.086 | — | — | — | — | — | — | — | — |
| AE | 0.92 | 0.086 | — | — | — | — | — | — | — | — |
| AF | 0.92 | 0.086 | — | — | — | — | — | — | — | — |
| AG | 0.92 | 0.086 | — | — | — | — | — | — | — | — |
| AH | 0.92 | 0.086 | — | — | — | — | — | — | — | — |
| AI | 0.92 | 0.086 | — | — | — | — | — | — | — | — |
| AJ | 0.92 | 0.086 | — | — | — | — | — | — | — | — |
| AK | 0.92 | 0.086 | — | — | — | — | — | — | — | — |

*Underline means outside the range of the present invention.

TABLE 2

| Steel | Composition (mass %) | | | | | | | | | | |
|---|---|---|---|---|---|---|---|---|---|---|---|
| type | C | Si | Mn | P | S | Cr | Ni | Mo | N | O | Al |
| AL | 0.026 | 0.24 | 0.24 | 0.015 | 0.0008 | 17.9 | 4.1 | 2.72 | 0.046 | 0.0015 | 0.036 |
| AM | 0.026 | 0.24 | 0.24 | 0.015 | 0.0008 | 18.1 | 4.1 | 2.72 | 0.046 | 0.0015 | 0.036 |
| AN | 0.026 | 0.24 | 0.24 | 0.015 | 0.0008 | 16.1 | 4.1 | 2.72 | 0.046 | 0.0015 | 0.036 |
| AO | 0.026 | 0.24 | 0.24 | 0.015 | 0.0008 | 15.9 | 4.1 | 2.72 | 0.046 | 0.0015 | 0.036 |
| AP | 0.026 | 0.24 | 0.24 | 0.015 | 0.0008 | 17.0 | 4.9 | 2.72 | 0.046 | 0.0015 | 0.036 |
| AQ | 0.026 | 0.24 | 0.24 | 0.015 | 0.0008 | 17.0 | 5.1 | 2.72 | 0.046 | 0.0015 | 0.036 |
| AR | 0.026 | 0.24 | 0.24 | 0.015 | 0.0008 | 17.0 | 3.0 | 2.72 | 0.046 | 0.0015 | 0.036 |
| AS | 0.026 | 0.24 | 0.24 | 0.015 | 0.0008 | 17.0 | 2.9 | 2.72 | 0.046 | 0.0015 | 0.036 |
| AT | 0.026 | 0.24 | 0.24 | 0.015 | 0.0008 | 17.0 | 4.1 | 2.90 | 0.046 | 0.0015 | 0.036 |
| AU | 0.026 | 0.24 | 0.24 | 0.015 | 0.0008 | 17.0 | 4.1 | 3.10 | 0.046 | 0.0015 | 0.036 |
| AV | 0.026 | 0.24 | 0.24 | 0.015 | 0.0008 | 17.0 | 4.1 | 2.10 | 0.046 | 0.0015 | 0.036 |
| AW | 0.026 | 0.24 | 0.24 | 0.015 | 0.0008 | 17.0 | 4.1 | 1.90 | 0.046 | 0.0015 | 0.036 |
| AX | 0.026 | 0.24 | 0.24 | 0.015 | 0.0008 | 17.0 | 4.1 | 2.72 | 0.070 | 0.0015 | 0.036 |
| AY | 0.026 | 0.24 | 0.24 | 0.015 | 0.0008 | 17.0 | 4.1 | 2.72 | 0.071 | 0.0015 | 0.036 |
| AZ | 0.026 | 0.24 | 0.24 | 0.015 | 0.0008 | 17.0 | 4.1 | 2.72 | 0.013 | 0.0015 | 0.036 |
| BA | 0.026 | 0.24 | 0.24 | 0.015 | 0.0008 | 17.0 | 4.1 | 2.72 | 0.011 | 0.0015 | 0.036 |
| BB | 0.026 | 0.24 | 0.24 | 0.015 | 0.0008 | 17.0 | 4.1 | 2.72 | 0.046 | 0.0095 | 0.036 |
| BC | 0.026 | 0.24 | 0.24 | 0.015 | 0.0008 | 17.0 | 4.1 | 2.72 | 0.046 | 0.0115 | 0.036 |
| BD | 0.026 | 0.24 | 0.24 | 0.015 | 0.0008 | 17.0 | 4.1 | 2.72 | 0.046 | 0.0015 | 0.095 |
| BE | 0.026 | 0.24 | 0.24 | 0.015 | 0.0008 | 17.0 | 4.1 | 2.72 | 0.046 | 0.0015 | 0.102 |
| BF | 0.026 | 0.24 | 0.24 | 0.015 | 0.0008 | 17.0 | 4.1 | 2.72 | 0.046 | 0.0015 | 0.002 |
| BG | 0.026 | 0.24 | 0.24 | 0.015 | 0.0008 | 17.0 | 4.1 | 2.72 | 0.046 | 0.0015 | 0.0009 |
| BH | 0.026 | 0.24 | 0.24 | 0.015 | 0.0008 | 17.0 | 4.1 | 2.72 | 0.046 | 0.0015 | 0.036 |
| BJ | 0.026 | 0.24 | 0.24 | 0.015 | 0.0008 | 17.0 | 4.1 | 2.72 | 0.046 | 0.0015 | 0.036 |
| BK | 0.026 | 0.24 | 0.24 | 0.015 | 0.0008 | 17.0 | 4.1 | 2.72 | 0.046 | 0.0015 | 0.036 |
| BL | 0.026 | 0.24 | 0.24 | 0.015 | 0.0008 | 17.0 | 4.1 | 2.72 | 0.046 | 0.0015 | 0.036 |
| BM | 0.026 | 0.24 | 0.24 | 0.015 | 0.0008 | 17.0 | 4.1 | 2.72 | 0.046 | 0.0015 | 0.036 |
| BN | 0.026 | 0.24 | 0.24 | 0.015 | 0.0008 | 17.0 | 4.1 | 2.72 | 0.046 | 0.0015 | 0.036 |
| BO | 0.026 | 0.24 | 0.24 | 0.015 | 0.0008 | 17.0 | 4.1 | 2.72 | 0.046 | 0.0015 | 0.036 |
| BP | 0.026 | 0.24 | 0.24 | 0.015 | 0.0008 | 17.0 | 4.1 | 2.72 | 0.046 | 0.0015 | 0.036 |
| BQ | 0.026 | 0.24 | 0.24 | 0.015 | 0.0008 | 17.0 | 4.1 | 2.72 | 0.046 | 0.0015 | 0.036 |
| BR | 0.026 | 0.24 | 0.24 | 0.015 | 0.0008 | 17.0 | 4.1 | 2.72 | 0.046 | 0.0015 | 0.036 |
| BS | 0.026 | 0.24 | 0.24 | 0.015 | 0.0008 | 17.0 | 4.1 | 2.72 | 0.046 | 0.0015 | 0.036 |
| BT | 0.026 | 0.24 | 0.24 | 0.015 | 0.0008 | 17.0 | 4.1 | 2.72 | 0.046 | 0.0015 | 0.036 |
| BU | 0.026 | 0.24 | 0.24 | 0.015 | 0.0008 | 17.0 | 4.1 | 2.72 | 0.046 | 0.0015 | 0.036 |
| BV | 0.026 | 0.24 | 0.24 | 0.015 | 0.0008 | 17.0 | 4.1 | 2.72 | 0.046 | 0.0015 | 0.036 |

| Steel | Composition (mass %) | | | | | | | | | | |
|---|---|---|---|---|---|---|---|---|---|---|---|
| type | Cu | W | Nb | V | Ta | Ti | B | Zr | Co | Ca | REM |
| AL | 0.94 | 0.92 | 0.086 | — | — | — | — | — | — | — | — |
| AM | 0.94 | 0.92 | 0.086 | — | — | — | — | — | — | — | — |
| AN | 0.94 | 0.92 | 0.086 | | | | | | | | |
| AO | 0.94 | 0.92 | 0.086 | — | — | — | — | — | — | — | — |
| AP | 0.94 | 0.92 | 0.086 | — | — | — | — | — | — | — | — |
| AQ | 0.94 | 0.92 | 0.086 | | | | | | | | |

TABLE 2-continued

| | | | | | | | | | | | |
|---|---|---|---|---|---|---|---|---|---|---|---|
| AR | 0.94 | 0.92 | 0.086 | — | — | — | — | — | — | — | — |
| AS | 0.94 | 0.92 | 0.086 | — | — | — | — | — | — | — | — |
| AT | 0.94 | 0.92 | 0.086 | — | — | — | — | — | — | — | — |
| AU | 0.94 | 0.92 | 0.086 | — | — | — | — | — | — | — | — |
| AV | 0.94 | 0.92 | 0.086 | — | — | — | — | — | — | — | — |
| AW | 0.94 | 0.92 | 0.086 | — | — | — | — | — | — | — | — |
| AX | 0.94 | 0.92 | 0.086 | — | — | — | — | — | — | — | — |
| AY | 0.94 | 0.92 | 0.086 | — | — | — | — | — | — | — | — |
| AZ | 0.94 | 0.92 | 0.086 | — | — | — | — | — | — | — | — |
| BA | 0.94 | 0.92 | 0.086 | — | — | — | — | — | — | — | — |
| BB | 0.94 | 0.92 | 0.086 | — | — | — | — | — | — | — | — |
| BC | 0.94 | 0.92 | 0.086 | — | — | — | — | — | — | — | — |
| BD | 0.94 | 0.92 | 0.086 | — | — | — | — | — | — | — | — |
| BE | 0.94 | 0.92 | 0.086 | — | — | — | — | — | — | — | — |
| BF | 0.94 | 0.92 | 0.086 | — | — | — | — | — | — | — | — |
| BG | 0.94 | 0.92 | 0.086 | — | — | — | — | — | — | — | — |
| BH | 3.48 | 0.92 | 0.086 | — | — | — | — | — | — | — | — |
| BJ | 0.51 | 0.92 | 0.086 | — | — | — | — | — | — | — | — |
| BK | 0.48 | 0.92 | 0.086 | — | — | — | — | — | — | — | — |
| BL | 0.94 | 2.98 | 0.086 | — | — | — | — | — | — | — | — |
| BM | 0.94 | 3.09 | 0.086 | — | — | — | — | — | — | — | — |
| BN | 0.94 | 0.02 | 0.086 | — | — | — | — | — | — | — | — |
| BO | 0.94 | 0.008 | 0.086 | — | — | — | — | — | — | — | — |
| BP | 0.94 | 0.92 | 0.498 | — | — | — | — | — | — | — | — |
| BQ | 0.94 | 0.92 | 0.553 | — | — | — | — | — | — | — | — |
| BR | 0.94 | 0.92 | 0.011 | — | — | — | — | — | — | — | — |
| BS | 0.94 | 0.92 | 0.009 | — | — | — | — | — | — | — | — |
| BT | 0.94 | 0.92 | 0.086 | — | — | — | 0.0048 | — | — | — | — |
| BU | 0.94 | 0.92 | 0.086 | — | — | — | 0.0098 | — | — | — | — |
| BV | 0.94 | 0.92 | 0.086 | — | — | — | 0.0102 | — | — | — | — |

*Underline means outside the range of the present invention.

TABLE 3

| | | Heat treatment step | | | | | | | | | | | | |
|---|---|---|---|---|---|---|---|---|---|---|---|---|---|---|
| | | Heating step | | Quenching | | | | | Austenite stabilizing heat treatment | | | Tempering | | |
| Steel pipe No. | Steel type | Heating temperature: T (° C.) | Holding time (min) | Quenching temperature (° C.) | Holding time (min) | Average cooling rate (° C./s) | Cooling method | Cooling stop temperature (° C.) | Heating temperature (° C.) | Holding time (min) | Cooling method | Tempering temperature (° C.) | Holding time (min) | Cooling method |
| 1 | A | 1290 | 60 | 960 | 20 | 1.6 | Water cooling | 24 | N/A | N/A | N/A | 630 | 30 | Air cooling |
| 2 | A | 1240 | 60 | 960 | 20 | 18.5 | Water cooling | 25 | 250 | 60 | Air cooling | 630 | 30 | Air cooling |
| 3 | A | 1210 | 60 | 960 | 20 | 10.3 | Water cooling | 28 | 450 | 60 | Air cooling | 630 | 30 | Air cooling |
| 5 | B | 1280 | 60 | 960 | 20 | 11.2 | Water cooling | 34 | 400 | 60 | Air cooling | 600 | 30 | Air cooling |
| 6 | C | 1260 | 60 | 960 | 20 | 30.0 | Water cooling | 30 | 450 | 30 | Air cooling | 630 | 30 | Air cooling |
| 7 | E | 1290 | 60 | 960 | 20 | 25.2 | Water cooling | 26 | 450 | 60 | Air cooling | 630 | 30 | Air cooling |
| 8 | F | 1200 | 60 | 920 | 20 | 9.1 | Water cooling | 36 | 400 | 60 | Air cooling | 600 | 30 | Air cooling |
| 9 | G | 1220 | 60 | 960 | 20 | 21.5 | Water cooling | 25 | 400 | 60 | Air cooling | 550 | 30 | Air cooling |
| 10 | H | 1210 | 60 | 960 | 20 | 11.7 | Water cooling | 35 | 400 | 60 | Air cooling | 550 | 30 | Air cooling |
| 11 | J | 1200 | 70 | 960 | 20 | 16.8 | Water cooling | 35 | 350 | 90 | Air cooling | 600 | 30 | Air cooling |
| 12 | K | 1290 | 60 | 960 | 20 | 3.0 | Water cooling | 26 | 450 | 60 | Air cooling | 630 | 30 | Air cooling |
| 13 | L | 1200 | 60 | 960 | 20 | 9.6 | Water cooling | 28 | 400 | 60 | Air cooling | 600 | 30 | Air cooling |
| 14 | M | 1260 | 60 | 960 | 20 | 8.5 | Water cooling | 27 | 400 | 60 | Air cooling | 580 | 30 | Air cooling |
| 15 | N | 1220 | 60 | 960 | 20 | 22.4 | Water cooling | 32 | 400 | 60 | Air cooling | 580 | 30 | Air cooling |
| 16 | O | 1220 | 115 | 960 | 20 | 10.8 | Water cooling | 32 | 400 | 60 | Air cooling | 580 | 30 | Air cooling |
| 17 | P | 1220 | 18 | 960 | 20 | 5.3 | Water cooling | 19 | 400 | 60 | Air cooling | 620 | 30 | Air cooling |
| 18 | Q | 1220 | 55 | 960 | 20 | 13.8 | Water cooling | 25 | 350 | 75 | Air cooling | 600 | 30 | Air cooling |
| 19 | R | 1220 | 32 | 960 | 20 | 10.1 | Water cooling | 24 | 300 | 90 | Air cooling | 580 | 30 | Air cooling |
| 20 | S | 1220 | 60 | 960 | 20 | 2.7 | Water cooling | 22 | 400 | 60 | Air cooling | 600 | 30 | Air cooling |
| 21 | T | 1240 | 60 | 960 | 20 | 18.5 | Water cooling | 25 | 250 | 60 | Air cooling | 630 | 30 | Air cooling |

TABLE 3-continued

| | | Heat treatment step | | | | | | | | | | | | |
|---|---|---|---|---|---|---|---|---|---|---|---|---|---|---|
| | | Heating step | | Quenching | | | | | Austenite stabilizing heat treatment | | | Tempering | | |
| Steel pipe No. | Steel type | Heating temperature: T (° C.) | Holding time (min) | Quenching temperature (° C.) | Holding time (min) | Average cooling rate (° C./s) | Cooling method | Cooling stop temperature (° C.) | Heating temperature (° C.) | Holding time (min) | Cooling method | Tempering temperature (° C.) | Holding time (min) | Cooling method |
| 22 | U | 1240 | 60 | 960 | 20 | 18.5 | Water cooling | 25 | 250 | 60 | Air cooling | 630 | 30 | Air cooling |
| 23 | V | 1240 | 60 | 960 | 20 | 18.5 | Water cooling | 25 | 250 | 60 | Air cooling | 630 | 30 | Air cooling |
| 24 | W | 1240 | 60 | 960 | 20 | 18.5 | Water cooling | 25 | 250 | 60 | Air cooling | 630 | 30 | Air cooling |
| 25 | X | 1240 | 60 | 960 | 20 | 18.5 | Water cooling | 25 | 250 | 60 | Air cooling | 630 | 30 | Air cooling |
| 26 | Y | 1240 | 60 | 960 | 20 | 18.5 | Water cooling | 25 | 250 | 60 | Air cooling | 630 | 30 | Air cooling |
| 27 | Z | 1240 | 60 | 960 | 20 | 18.5 | Water cooling | 25 | 250 | 60 | Air cooling | 630 | 30 | Air cooling |
| 28 | AA | 1240 | 60 | 960 | 20 | 18.5 | Water cooling | 25 | 250 | 60 | Air cooling | 630 | 30 | Air cooling |
| 29 | AB | 1240 | 60 | 960 | 20 | 18.5 | Water cooling | 25 | 250 | 60 | Air cooling | 630 | 30 | Air cooling |
| 30 | AC | 1240 | 60 | 960 | 20 | 18.5 | Water cooling | 25 | 250 | 60 | Air cooling | 630 | 30 | Air cooling |
| 31 | AD | 1240 | 60 | 960 | 20 | 18.5 | Water cooling | 25 | 250 | 60 | Air cooling | 630 | 30 | Air cooling |
| 32 | AE | 1240 | 60 | 960 | 20 | 18.5 | Water cooling | 25 | 250 | 60 | Air cooling | 630 | 30 | Air cooling |
| 33 | AF | 1240 | 60 | 960 | 20 | 18.5 | Water cooling | 25 | 250 | 60 | Air cooling | 630 | 30 | Air cooling |
| 34 | AG | 1240 | 60 | 960 | 20 | 18.5 | Water cooling | 25 | 250 | 60 | Air cooling | 630 | 30 | Air cooling |
| 35 | AH | 1240 | 60 | 960 | 20 | 18.5 | Water cooling | 25 | 250 | 60 | Air cooling | 630 | 30 | Air cooling |
| 36 | AI | 1240 | 60 | 960 | 20 | 18.5 | Water cooling | 25 | 250 | 60 | Air cooling | 630 | 30 | Air cooling |
| 37 | AJ | 1240 | 60 | 960 | 20 | 18.5 | Water cooling | 25 | 250 | 60 | Air cooling | 630 | 30 | Air cooling |
| 38 | AK | 1240 | 60 | 960 | 20 | 18.5 | Water cooling | 25 | 250 | 60 | Air cooling | 630 | 30 | Air cooling |
| 39 | AL | 1240 | 60 | 960 | 20 | 18.5 | Water cooling | 25 | 250 | 60 | Air cooling | 630 | 30 | Air cooling |
| 40 | AM | 1240 | 60 | 960 | 20 | 18.5 | Water cooling | 25 | 250 | 60 | Air cooling | 630 | 30 | Air cooling |
| 41 | AN | 1240 | 60 | 960 | 20 | 18.5 | Water cooling | 25 | 250 | 60 | Air cooling | 630 | 30 | Air cooling |
| 42 | AO | 1240 | 60 | 960 | 20 | 18.5 | Water cooling | 25 | 250 | 60 | Air cooling | 630 | 30 | Air cooling |
| 43 | AP | 1240 | 60 | 960 | 20 | 18.5 | Water cooling | 25 | 250 | 60 | Air cooling | 630 | 30 | Air cooling |
| 44 | AQ | 1240 | 60 | 960 | 20 | 18.5 | Water cooling | 25 | 250 | 60 | Air cooling | 630 | 30 | Air cooling |
| 45 | AR | 1240 | 60 | 960 | 20 | 18.5 | Water cooling | 25 | 250 | 60 | Air cooling | 630 | 30 | Air cooling |
| 46 | AS | 1240 | 60 | 960 | 20 | 18.5 | Water cooling | 25 | 250 | 60 | Air cooling | 630 | 30 | Air cooling |
| 47 | AT | 1240 | 60 | 960 | 20 | 18.5 | Water cooling | 25 | 250 | 60 | Air cooling | 630 | 30 | Air cooling |

*Underline means outside the range of the present invention.

TABLE 4

| | | Heat treatment step | | | | | | | | | | | | |
|---|---|---|---|---|---|---|---|---|---|---|---|---|---|---|
| | | Heating step | | Quenching | | | | | Austenite stabilizing heat treatment | | | Tempering | | |
| Steel pipe No. | Steel type | Heating temperature: T (° C.) | Holding time (min) | Quenching temperature (° C.) | Holding time (min) | Average cooling rate (° C./s) | Cooling method | Cooling stop temperature (° C.) | Heating temperature (° C.) | Holding time (min) | Cooling method | Tempering temperature (° C.) | Holding time (min) | Cooling method |
| 48 | AU | 1240 | 60 | 960 | 20 | 18.5 | Water cooling | 25 | 250 | 60 | Air cooling | 630 | 30 | Air cooling |
| 49 | AV | 1240 | 60 | 960 | 20 | 18.5 | Water cooling | 25 | 250 | 60 | Air cooling | 630 | 30 | Air cooling |
| 50 | AW | 1240 | 60 | 960 | 20 | 18.5 | Water cooling | 25 | 250 | 60 | Air cooling | 630 | 30 | Air cooling |
| 51 | AX | 1240 | 60 | 960 | 20 | 18.5 | Water cooling | 25 | 250 | 60 | Air cooling | 630 | 30 | Air cooling |
| 52 | AY | 1240 | 60 | 960 | 20 | 18.5 | Water cooling | 25 | 250 | 60 | Air cooling | 630 | 30 | Air cooling |
| 53 | AZ | 1240 | 60 | 960 | 20 | 18.5 | Water cooling | 25 | 250 | 60 | Air cooling | 630 | 30 | Air cooling |
| 54 | BA | 1240 | 60 | 960 | 20 | 18.5 | Water cooling | 25 | 250 | 60 | Air cooling | 630 | 30 | Air cooling |
| 55 | BB | 1240 | 60 | 960 | 20 | 18.5 | Water cooling | 25 | 250 | 60 | Air cooling | 630 | 30 | Air cooling |
| 56 | BC | 1240 | 60 | 960 | 20 | 18.5 | Water cooling | 25 | 250 | 60 | Air cooling | 630 | 30 | Air cooling |
| 57 | BD | 1240 | 60 | 960 | 20 | 18.5 | Water cooling | 25 | 250 | 60 | Air cooling | 630 | 30 | Air cooling |
| 58 | BE | 1240 | 60 | 960 | 20 | 18.5 | Water cooling | 25 | 250 | 60 | Air cooling | 630 | 30 | Air cooling |
| 59 | BF | 1240 | 60 | 960 | 20 | 18.5 | Water cooling | 25 | 250 | 60 | Air cooling | 630 | 30 | Air cooling |
| 60 | BG | 1240 | 60 | 960 | 20 | 18.5 | Water cooling | 25 | 250 | 60 | Air cooling | 630 | 30 | Air cooling |
| 61 | BH | 1240 | 60 | 960 | 20 | 18.5 | Water cooling | 25 | 250 | 60 | Air cooling | 630 | 30 | Air cooling |
| 62 | BJ | 1240 | 60 | 960 | 20 | 18.5 | Water cooling | 25 | 250 | 60 | Air cooling | 630 | 30 | Air cooling |
| 63 | BK | 1240 | 60 | 960 | 20 | 18.5 | Water cooling | 25 | 250 | 60 | Air cooling | 630 | 30 | Air cooling |
| 64 | BL | 1240 | 60 | 960 | 20 | 18.5 | Water cooling | 25 | 250 | 60 | Air cooling | 630 | 30 | Air cooling |
| 65 | BM | 1240 | 60 | 960 | 20 | 18.5 | Water cooling | 25 | 250 | 60 | Air cooling | 630 | 30 | Air cooling |
| 66 | BN | 1240 | 60 | 960 | 20 | 18.5 | Water cooling | 25 | 250 | 60 | Air cooling | 630 | 30 | Air cooling |
| 67 | BO | 1240 | 60 | 960 | 20 | 18.5 | Water cooling | 25 | 250 | 60 | Air cooling | 630 | 30 | Air cooling |
| 68 | BP | 1240 | 60 | 960 | 20 | 18.5 | Water cooling | 25 | 250 | 60 | Air cooling | 630 | 30 | Air cooling |
| 69 | BQ | 1240 | 60 | 960 | 20 | 18.5 | Water cooling | 25 | 250 | 60 | Air cooling | 630 | 30 | Air cooling |

TABLE 4-continued

| | | Heating step | | Heat treatment step | | | | | | | | | | |
|---|---|---|---|---|---|---|---|---|---|---|---|---|---|---|
| | | | | Quenching | | | | | Austenite stabilizing heat treatment | | | Tempering | | |
| Steel pipe No. | Steel type | Heating temperature: T (° C.) | Holding time (min) | Quenching temperature (° C.) | Holding time (min) | Average cooling rate (° C./s) | Cooling method | Cooling stop temperature (° C.) | Heating temperature (° C.) | Holding time (min) | Cooling method | Tempering temperature (° C.) | Holding time (min) | Cooling method |
| 70 | BR | 1240 | 60 | 960 | 20 | 18.5 | Water cooling | 25 | 250 | 60 | Air cooling | 630 | 30 | Air cooling |
| 71 | BS | 1240 | 60 | 960 | 20 | 18.5 | Water cooling | 25 | 250 | 60 | Air cooling | 630 | 30 | Air cooling |
| 72 | BT | 1240 | 60 | 960 | 20 | 18.5 | Water cooling | 25 | 250 | 60 | Air cooling | 630 | 30 | Air cooling |
| 73 | BU | 1240 | 60 | 960 | 20 | 18.5 | Water cooling | 25 | 250 | 60 | Air cooling | 630 | 30 | Air cooling |
| 74 | BV | 1240 | 60 | 960 | 20 | 18.5 | Water cooling | 25 | 250 | 60 | Air cooling | 630 | 30 | Air cooling |
| 75 | A | 1310 | 60 | 960 | 20 | 18.5 | Water cooling | 25 | 250 | 60 | Air cooling | 630 | 30 | Air cooling |
| 76 | A | 1280 | 60 | 960 | 20 | 18.5 | Water cooling | 25 | 250 | 60 | Air cooling | 630 | 30 | Air cooling |
| 77 | A | 1110 | 60 | 960 | 20 | 18.5 | Water cooling | 25 | 250 | 60 | Air cooling | 630 | 30 | Air cooling |
| 78 | A | 1240 | 60 | 1160 | 20 | 18.5 | Water cooling | 25 | 250 | 60 | Air cooling | 630 | 30 | Air cooling |
| 79 | A | 1240 | 60 | 1140 | 20 | 18.5 | Water cooling | 25 | 250 | 60 | Air cooling | 630 | 30 | Air cooling |
| 80 | A | 1240 | 60 | 840 | 20 | 18.5 | Water cooling | 25 | 250 | 60 | Air cooling | 630 | 30 | Air cooling |
| 81 | A | 1240 | 60 | 860 | 20 | 18.5 | Water cooling | 25 | 250 | 60 | Air cooling | 630 | 30 | Air cooling |
| 82 | A | 1240 | 60 | 960 | 20 | 0.044 | Water cooling | 25 | 250 | 60 | Air cooling | 630 | 30 | Air cooling |
| 83 | A | 1240 | 60 | 960 | 20 | 0.051 | Water cooling | 25 | 250 | 60 | Air cooling | 630 | 30 | Air cooling |
| 84 | A | 1240 | 60 | 960 | 20 | 18.5 | Water cooling | 52 | 250 | 60 | Air cooling | 630 | 30 | Air cooling |
| 85 | A | 1240 | 60 | 960 | 20 | 18.5 | Water cooling | 48 | 250 | 60 | Air cooling | 630 | 30 | Air cooling |
| 86 | A | 1240 | 60 | 960 | 20 | 18.5 | Water cooling | 1 | 250 | 60 | Air cooling | 630 | 30 | Air cooling |
| 87 | A | 1240 | 60 | 960 | 20 | 18.5 | Water cooling | 25 | 510 | 60 | Air cooling | 630 | 30 | Air cooling |
| 88 | A | 1240 | 60 | 960 | 20 | 18.5 | Water cooling | 25 | 490 | 60 | Air cooling | 630 | 30 | Air cooling |
| 89 | A | 1240 | 60 | 960 | 20 | 18.5 | Water cooling | 25 | 190 | 60 | Air cooling | 630 | 30 | Air cooling |
| 90 | A | 1240 | 60 | 960 | 20 | 18.5 | Water cooling | 25 | 210 | 60 | Air cooling | 630 | 30 | Air cooling |
| 91 | A | 1240 | 60 | 960 | 20 | 18.5 | Water cooling | 25 | 250 | 60 | Air cooling | 660 | 30 | Air cooling |
| 92 | A | 1240 | 60 | 960 | 20 | 18.5 | Water cooling | 25 | 250 | 60 | Air cooling | 640 | 30 | Air cooling |
| 93 | A | 1240 | 60 | 960 | 20 | 18.5 | Water cooling | 25 | 250 | 60 | Air cooling | 490 | 30 | Air cooling |
| 94 | A | 1240 | 60 | 960 | 20 | 18.5 | Water cooling | 25 | 250 | 60 | Air cooling | 510 | 30 | Air cooling |

*Underline means outside the range of the present invention.

TABLE 5

| Steel pipe No. | Steel type | Structure after heat treatment step: Volume fraction of tempered martensite phase (%) | Volume fraction of ferrite phase (%) | Volume fraction of residual austenite phase (%) | Chemical composition of residual austenite phase: C (mass %) | Cr (mass %) | Ni (mass %) | Mo (mass %) | N (mass %) | W (mass %) | Cu (mass %) | $Md_{30}$*2 (° C.) | Tensile characteristics: Yield strength YS (MPa) | Tensile strength TS (MPa) | Low-temperature toughness: $vE_{-10}$ (J) | $vE_{-40}$ (J) | Corrosion characteristics: Corrosion rate (mm/y) | SSC resistance Cracking*3 | SCC resistance Cracking*3 | Remarks |
|---|---|---|---|---|---|---|---|---|---|---|---|---|---|---|---|---|---|---|---|---|
| 1 | A | 59 | 30 | 11 | 0.03 | 17.3 | 6.3 | 1.0 | 0.02 | 0.3 | 1.0 | 19.4 | 826 | 998 | 57 | 13 | 0.095 | Absent | Absent | Comparative Example |
| 2 | A | 60 | 30 | 10 | 0.04 | 17.5 | 6.4 | 1.0 | 0.03 | 0.3 | 1.0 | −18.0 | 832 | 1005 | 138 | 70 | 0.115 | Absent | Absent | Present Example |
| 3 | A | 56 | 35 | 9 | 0.05 | 17.3 | 6.8 | 1.0 | 0.04 | 0.3 | 1.0 | −49.6 | 830 | 1003 | 117 | 55 | 0.110 | Absent | Absent | Present Example |
| 5 | B | 68 | 23 | 9 | 0.05 | 16.8 | 6.6 | 1.0 | 0.04 | 0.3 | 1.0 | −19.8 | 874 | 1034 | 95 | 53 | 0.097 | Absent | Absent | Present Example |
| 6 | C | 56 | 33 | 11 | 0.04 | 17.3 | 7.2 | 1.0 | 0.02 | 0.3 | 1.0 | −33.5 | 862 | 949 | 103 | 49 | 0.063 | Absent | Absent | Present Example |
| 7 | E | 54 | 34 | 12 | 0.05 | 16.9 | 6.5 | 0.9 | 0.04 | 0.3 | 0.9 | −15.3 | 809 | 963 | 100 | 45 | 0.102 | Absent | Absent | Present Example |
| 8 | F | 64 | 26 | 10 | 0.03 | 17.2 | 5.9 | 0.9 | 0.05 | 0.6 | 0.9 | 19.0 | 724 | 895 | 58 | 11 | 0.106 | Absent | Absent | Comparative Example |
| 9 | G | 72 | 20 | 8 | 0.05 | 14.9 | 5.6 | 1.0 | 0.05 | 0.8 | 4.3 | 45.5 | 930 | 1019 | 29 | 19 | 0.135 | Present | Present | Comparative Example |
| 10 | H | 37 | 58 | 5 | 0.04 | 18.8 | 4.2 | 0.8 | 0.03 | 0.0 | 0.2 | 32.9 | 966 | 1050 | 47 | 20 | 0.195 | Present | Present | Comparative Example |
| 11 | J | 65 | 27 | 8 | 0.03 | 17.8 | 6.6 | 1.0 | 0.02 | 0.3 | 1.0 | −14.3 | 865 | 1038 | 104 | 53 | 0.107 | Absent | Absent | Present Example |
| 12 | K | 60 | 32 | 8 | 0.05 | 17.4 | 6.7 | 1.0 | 0.04 | 0.3 | 1.0 | −50.1 | 825 | 1019 | 113 | 53 | 0.107 | Absent | Absent | Present Example |
| 13 | L | 66 | 25 | 9 | 0.05 | 16.6 | 6.9 | 1.0 | 0.04 | 0.3 | 1.0 | −22.7 | 890 | 1060 | 103 | 50 | 0.091 | Absent | Absent | Present Example |
| 14 | M | 48 | 33 | 19 | 0.05 | 17.2 | 6.3 | 1.0 | 0.02 | 0.3 | 2.6 | −32.5 | 859 | 1043 | 102 | 49 | 0.088 | Absent | Absent | Present Example |
| 15 | N | 52 | 32 | 16 | 0.05 | 17.1 | 6.2 | 1.0 | 0.02 | 0.3 | 2.6 | −24.2 | 846 | 1032 | 102 | 51 | 0.101 | Absent | Absent | Present Example |
| 16 | O | 56 | 23 | 21 | 0.03 | 17.2 | 4.4 | 2.8 | 0.04 | 0.6 | 3.2 | −15.8 | 891 | 969 | 102 | 51 | 0.073 | Absent | Absent | Present Example |
| 17 | P | 52 | 37 | 11 | 0.04 | 17.7 | 3.9 | 2.9 | 0.03 | 0.9 | 1.3 | −11.8 | 870 | 965 | 93 | 46 | 0.053 | Absent | Absent | Present Example |
| 18 | Q | 55 | 30 | 15 | 0.04 | 17.3 | 5.1 | 2.8 | 0.02 | 1.0 | 2.6 | −48.4 | 846 | 950 | 121 | 63 | 0.080 | Absent | Absent | Present Example |
| 19 | R | 48 | 35 | 17 | 0.05 | 17.1 | 4.4 | 2.6 | 0.04 | 1.2 | 1.2 | −24.0 | 888 | 978 | 106 | 57 | 0.098 | Absent | Absent | Present Example |
| 20 | S | 61 | 26 | 13 | 0.05 | 17.5 | 4.2 | 2.45 | 0.03 | 0.06 | 1.9 | −11.7 | 961 | 1073 | 95 | 46 | 0.072 | Absent | Absent | Present Example |

TABLE 5-continued

| Steel pipe No. | Steel type | Structure after heat treatment step: Volume fraction of tempered martensite phase (%) | Volume fraction of ferrite phase (%) | Volume fraction of residual austenite phase (%) | Chemical composition of residual austenite phase: C (mass %) | Cr (mass %) | Ni (mass %) | Mo (mass %) | N (mass %) | W (mass %) | Cu (mass %) | $Md_{30}$*2 (° C.) | Tensile characteristics: Yield strength YS (MPa) | Tensile strength TS (MPa) | Low-temperature toughness: $vE_{-10}$ (J) | $vE_{-40}$ (J) | Corrosion characteristics: Corrosion rate (mm/y) | SSC resistance Cracking*3 | SCC resistance Cracking*3 | Remarks |
|---|---|---|---|---|---|---|---|---|---|---|---|---|---|---|---|---|---|---|---|---|
| 21 | X | 53 | 27 | 20 | 0.07 | 17.5 | 4.3 | 2.7 | 0.02 | 0.03 | 1.2 | −43.9 | 777 | 901 | 113 | 60 | 0.097 | Absent | Absent | Present Example |
| 22 | U | 41 | 29 | 30 | 0.07 | 17.4 | 4.3 | 2.7 | 0.02 | 0.03 | 1.2 | −39.5 | 743 | 891 | 120 | 62 | 0.133 | Absent | Absent | Comparative Example |
| 23 | V | 73 | 22 | 5 | 0.05 | 17.4 | 4.3 | 2.7 | 0.04 | 0.03 | 1.2 | −17.9 | 941 | 1051 | 85 | 43 | 0.098 | Absent | Absent | Present Example |
| 24 | W | 76 | 22 | 2 | 0.03 | 17 | 4.5 | 2.8 | 0.04 | 0.6 | 3.2 | −10.9 | 960 | 1076 | 76 | 20 | 0.101 | Absent | Absent | Comparative Example |
| 25 | X | 52 | 32 | 16 | 0.05 | 17.1 | 6.2 | 1.0 | 0.02 | 0.3 | 2.6 | −24.2 | 792 | 904 | 102 | 51 | 0.116 | Absent | Absent | Present Example |
| 26 | Y | 61 | 26 | 13 | 0.04 | 17.7 | 3.9 | 2.9 | 0.03 | 0.9 | 1.3 | −11.8 | 891 | 969 | 102 | 51 | 0.151 | Absent | Present | Comparative Example |
| 27 | Z | 60 | 26 | 14 | 0.04 | 17.7 | 3.9 | 3.1 | 0.03 | 0.9 | 1.3 | −19.2 | 891 | 969 | 102 | 51 | 0.053 | Absent | Absent | Present Example |
| 28 | AA | 62 | 25 | 13 | 0.05 | 17.4 | 4.3 | 2.6 | 0.04 | 0.03 | 1.2 | −14.2 | 870 | 965 | 77 | 30 | 0.134 | Present | Present | Comparative Example |
| 29 | AB | 62 | 22 | 16 | 0.05 | 17.1 | 4.3 | 3.1 | 0.02 | 0.9 | 2.6 | −36.1 | 846 | 950 | 84 | 44 | 0.095 | Absent | Absent | Present Example |
| 30 | AC | 47 | 32 | 21 | 0.04 | 17.2 | 4.3 | 2.6 | 0.04 | 1.0 | 2.0 | −12.6 | 888 | 978 | 78 | 31 | 0.095 | Absent | Absent | Comparative Example |
| 31 | AD | 63 | 26 | 11 | 0.04 | 17.7 | 4.3 | 2.9 | 0.03 | 1.2 | 1.9 | −40.4 | 777 | 1073 | 113 | 60 | 0.072 | Absent | Absent | Present Example |
| 32 | AE | 59 | 26 | 15 | 0.05 | 17.3 | 4.4 | 2.8 | 0.04 | 0.06 | 1.2 | −20.5 | 743 | 891 | 120 | 62 | 0.038 | Absent | Absent | Comparative Example |
| 33 | AF | 58 | 25 | 17 | 0.05 | 17.1 | 6.2 | 2.6 | 0.04 | 0.03 | 1.2 | −76.6 | 843 | 965 | 120 | 49 | 0.119 | Absent | Absent | Present Example |
| 34 | AG | 55 | 32 | 13 | 0.05 | 17.5 | 4.5 | 2.45 | 0.03 | 0.03 | 1.3 | −15.2 | 941 | 1051 | 85 | 43 | 0.137 | Present | Present | Comparative Example |
| 35 | AH | 57 | 23 | 20 | 0.07 | 17.5 | 3.9 | 2.7 | 0.02 | 0.03 | 3.2 | −54.3 | 891 | 969 | 102 | 51 | 0.067 | Absent | Absent | Present Example |
| 36 | AI | 41 | 37 | 22 | 0.07 | 17.4 | 4.3 | 1.5 | 0.02 | 0.6 | 2.6 | −21.8 | 870 | 965 | 93 | 46 | 0.102 | Absent | Absent | Present Example |
| 37 | AJ | 66 | 20 | 14 | 0.05 | 17.4 | 4.3 | 2.8 | 0.04 | 0.3 | 1.3 | −27.0 | 846 | 950 | 121 | 63 | 0.142 | Present | Present | Comparative Example |
| 38 | AK | 52 | 35 | 13 | 0.04 | 17 | 4.3 | 2.9 | 0.04 | 1.0 | 1.7 | −11.0 | 888 | 978 | 106 | 57 | 0.053 | Absent | Absent | Present Example |
| 39 | AL | 42 | 38 | 20 | 0.05 | 17.1 | 4.3 | 2.8 | 0.02 | 0.9 | 2.6 | −23.9 | 961 | 1073 | 95 | 46 | 0.049 | Absent | Absent | Present Example |
| 40 | AM | 38 | 41 | 21 | 0.04 | 17.2 | 4.4 | 2.6 | 0.03 | 1.0 | 2.2 | −13.6 | 743 | 901 | 113 | 60 | 0.034 | Absent | Absent | Comparative Example |

TABLE 5-continued

| Steel pipe No. | Steel type | Structure after heat treatment step: Volume fraction of tempered martensite phase (%) | Volume fraction of ferrite phase (%) | Volume fraction of residual austenite phase (%) | Chemical composition of residual austenite phase: C (mass %) | Cr (mass %) | Ni (mass %) | Mo (mass %) | N (mass %) | W (mass %) | Cu (mass %) | $Md_{30}$*2 (° C.) | Tensile characteristics: Yield strength YS (MPa) | Tensile strength TS (MPa) | Low-temperature toughness: $vE_{-10}$ (J) | $vE_{-40}$ (J) | Corrosion characteristics: Corrosion rate (mm/y) | SSC resistance Cracking*3 | SCC resistance Cracking*3 | Remarks |
|---|---|---|---|---|---|---|---|---|---|---|---|---|---|---|---|---|---|---|---|---|
| 41 | AN | 60 | 29 | 11 | 0.04 | 17.7 | 6.2 | 2.45 | 0.03 | 1.2 | 1.9 | −97.9 | 911 | 1031 | 89 | 46 | 0.104 | Absent | Absent | Present Example |
| 42 | AO | 63 | 22 | 15 | 0.05 | 17.3 | 3.9 | 2.7 | 0.04 | 0.7 | 1.5 | −11.9 | 932 | 1036 | 81 | 43 | 0.135 | Present | Present | Comparative Example |
| 43 | AP | 61 | 22 | 17 | 0.05 | 17.1 | 5.1 | 2.1 | 0.02 | 0.6 | 2.5 | −25.2 | 846 | 950 | 121 | 63 | 0.051 | Absent | Absent | Present Example |
| 44 | AQ | 38 | 32 | 30 | 0.03 | 17.5 | 4.3 | 2.8 | 0.04 | 1.1 | 1.5 | −10.5 | 751 | 860 | 106 | 57 | 0.046 | Absent | Absent | Comparative Example |
| 45 | AR | 42 | 38 | 20 | 0.04 | 17.5 | 4.3 | 2.9 | 0.03 | 0.03 | 3.2 | −31.0 | 780 | 888 | 95 | 46 | 0.088 | Absent | Absent | Present Example |
| 46 | AS | 46 | 26 | 28 | 0.04 | 17.4 | 4.3 | 2.8 | 0.02 | 0.6 | 2.6 | −15.5 | 743 | 891 | 113 | 60 | 0.130 | Absent | Absent | Comparative Example |
| 47 | AT | 61 | 25 | 14 | 0.05 | 17.4 | 4.3 | 2.6 | 0.04 | 0.3 | 1.3 | −21.0 | 780 | 891 | 120 | 62 | 0.046 | Absent | Absent | Present Example |

*1Underline means outside the range of the present invention.

*2$Md_{30}$ = 1148 − 1775C − 44Cr − 39Ni − 37Mo − 698N − 15W − 13Cu ≤ −10 . . . Formula (1)

C, Cr, Ni, Mo, N, W, and Cu represent the content of each element in the residual austenite phase in mass % (the content being 0 (zero) for elements that are not contained).

TABLE 6

| Steel pipe No. | Steel type | Structure after heat treatment step: Volume fraction of tempered martensite phase (%) | Volume fraction of ferrite phase (%) | Volume fraction of residual austenite phase (%) | Chemical composition of residual austenite phase: C (mass %) | Cr (mass %) | Ni (mass %) | Mo (mass %) | N (mass %) | W (mass %) | Cu (mass %) | $Md_{30}$*2 (° C.) | Tensile characteristics: Yield strength YS (MPa) | Tensile strength TS (MPa) | Low-temperature toughness: $vE_{-10}$ (J) | $vE_{-40}$ (J) | Corrosion characteristics: Corrosion rate (mm/y) | SSC resistance Cracking*3 | SCC resistance Cracking*3 | Remarks |
|---|---|---|---|---|---|---|---|---|---|---|---|---|---|---|---|---|---|---|---|---|
| 48 | AU | 65 | 22 | 13 | 0.05 | 17 | 4.4 | 2.45 | 0.03 | 1.0 | 2.4 | −18.1 | 941 | 1051 | 78 | 35 | 0.072 | Absent | Absent | Comparative Example |
| 49 | AV | 52 | 32 | 16 | 0.07 | 17.1 | 6.2 | 2.7 | 0.02 | 0.9 | 2.6 | −130.9 | 891 | 969 | 102 | 51 | 0.101 | Absent | Absent | Present Example |
| 50 | AW | 53 | 26 | 21 | 0.07 | 17.2 | 3.9 | 2.1 | 0.02 | 1.0 | 1.9 | −16.5 | 870 | 965 | 93 | 46 | 0.135 | Present | Present | Comparative Example |
| 51 | AX | 63 | 26 | 11 | 0.05 | 17.7 | 3.9 | 2.8 | 0.04 | 1.2 | 1.9 | 45.9 | 846 | 950 | 121 | 63 | 0.067 | Absent | Absent | Present Example |
| 52 | AY | 60 | 25 | 15 | 0.04 | 17.5 | 4.3 | 2.8 | 0.03 | 1.1 | 3.2 | −43.3 | 888 | 978 | 75 | 35 | 0.077 | Absent | Absent | Comparative Example |
| 53 | AZ | 51 | 32 | 17 | 0.05 | 17.1 | 4.3 | 2.8 | 0.02 | 1.1 | 1.3 | −10.7 | 961 | 1073 | 95 | 46 | 0.094 | Absent | Absent | Present Example |
| 54 | BA | 61 | 26 | 13 | 0.04 | 17.5 | 4.3 | 2.6 | 0.03 | 1.2 | 1.2 | −12.9 | 777 | 901 | 113 | 60 | 0.156 | Present | Present | Comparative Example |
| 55 | BB | 62 | 22 | 16 | 0.04 | 17.5 | 4.3 | 2.45 | 0.03 | 0.03 | 3.2 | −14.3 | 903 | 1000 | 89 | 44 | 0.099 | Absent | Absent | Present Example |
| 56 | BC | 47 | 32 | 21 | 0.05 | 17.4 | 4.4 | 2.7 | 0.04 | 0.6 | 2.6 | −48.6 | 941 | 1051 | 71 | 33 | 0.137 | Present | Present | Comparative Example |
| 57 | BD | 63 | 26 | 11 | 0.05 | 17.4 | 6.2 | 2.8 | 0.03 | 0.3 | 1.3 | −93.0 | 960 | 1076 | 86 | 50 | 0.059 | Absent | Absent | Present Example |
| 58 | BE | 59 | 26 | 15 | 0.04 | 17.4 | 3.9 | 2.6 | 0.03 | 2.6 | 2.0 | −24.3 | 840 | 904 | 70 | 26 | 0.068 | Absent | Absent | Comparative Example |
| 59 | BF | 58 | 25 | 17 | 0.04 | 17.4 | 3.9 | 2.45 | 0.04 | 1.1 | 3.2 | −17.4 | 870 | 965 | 93 | 46 | 0.072 | Absent | Absent | Present Example |
| 60 | BG | 55 | 32 | 13 | 0.05 | 17.4 | 4.3 | 2.7 | 0.03 | 0.3 | 2.6 | −33.2 | 870 | 965 | 61 | 22 | 0.071 | Absent | Absent | Comparative Example |
| 61 | BH | 57 | 23 | 20 | 0.05 | 17 | 3.9 | 2.7 | 0.04 | 1.1 | 2.0 | −11.2 | 846 | 950 | 121 | 63 | 0.077 | Absent | Absent | Present Example |
| 62 | BJ | 60 | 29 | 11 | 0.05 | 17.4 | 4.3 | 2.6 | 0.04 | 0.3 | 1.3 | −21.0 | 891 | 969 | 102 | 51 | 0.097 | Absent | Absent | Present Example |
| 63 | BK | 63 | 22 | 15 | 0.05 | 17 | 4.4 | 2.45 | 0.03 | 1.0 | 2.4 | −18.1 | 870 | 965 | 93 | 46 | 0.133 | Present | Present | Comparative Example |
| 64 | BL | 61 | 22 | 17 | 0.07 | 17.1 | 6.2 | 2.7 | 0.02 | 0.9 | 2.6 | −130.9 | 846 | 950 | 121 | 63 | 0.059 | Absent | Absent | Present Example |
| 65 | BM | 55 | 32 | 13 | 0.07 | 17.2 | 3.9 | 2.1 | 0.02 | 1.0 | 1.9 | −16.5 | 888 | 978 | 64 | 28 | 0.068 | Absent | Absent | Comparative Example |
| 66 | BN | 54 | 26 | 20 | 0.05 | 17.7 | 3.9 | 2.8 | 0.04 | 1.2 | 1.9 | −45.9 | 961 | 1073 | 95 | 49 | 0.099 | Absent | Absent | Present Example |

TABLE 6-continued

| Steel pipe No. | Steel type | Structure after heat treatment step: Volume fraction of tempered martensite phase (%) | Volume fraction of ferrite phase (%) | Volume fraction of residual austenite phase (%) | Chemical composition of residual austenite phase: C (mass %) | Cr (mass %) | Ni (mass %) | Mo (mass %) | N (mass %) | W (mass %) | Cu (mass %) | $Md_{30}$*2 (° C.) | Tensile characteristics: Yield strength YS (MPa) | Tensile strength TS (MPa) | Low-temperature toughness: $vE_{-10}$ (J) | $vE_{-40}$ (J) | Corrosion characteristics: Corrosion rate (mm/y) | SSC resistance Cracking*3 | SCC resistance Cracking*3 | Remarks |
|---|---|---|---|---|---|---|---|---|---|---|---|---|---|---|---|---|---|---|---|---|
| 67 | BO | 44 | 26 | 30 | 0.04 | 17.5 | 4.3 | 2.8 | 0.03 | 1.1 | 3.2 | −43.3 | 777 | 901 | 113 | 60 | 0.137 | Present | Present | Comparative Example |
| 68 | BP | 61 | 25 | 14 | 0.05 | 17.1 | 4.3 | 2.8 | 0.02 | 1.1 | 1.3 | −10.7 | 844 | 961 | 120 | 62 | 0.077 | Absent | Absent | Present Example |
| 69 | BQ | 65 | 22 | 13 | 0.04 | 17.5 | 4.3 | 2.6 | 0.03 | 1.2 | 1.2 | −12.9 | 870 | 965 | 78 | 38 | 0.064 | Present | Absent | Comparative Example |
| 70 | BR | 52 | 32 | 16 | 0.04 | 17.5 | 4.3 | 2.45 | 0.03 | 0.03 | 3.2 | −14.3 | 777 | 901 | 113 | 60 | 0.049 | Absent | Absent | Present Example |
| 71 | BS | 61 | 22 | 17 | 0.05 | 17.4 | 4.4 | 2.7 | 0.04 | 0.6 | 2.6 | −48.6 | 743 | 861 | 120 | 62 | 0.056 | Absent | Absent | Comparative Example |
| 72 | BT | 55 | 32 | 13 | 0.05 | 17.4 | 6.2 | 2.8 | 0.03 | 0.3 | 1.3 | −93.0 | 870 | 965 | 93 | 46 | 0.055 | Absent | Absent | Present Example |
| 73 | BU | 54 | 26 | 20 | 0.04 | 17.5 | 4.3 | 2.6 | 0.03 | 1.2 | 1.2 | −12.9 | 846 | 950 | 121 | 63 | 0.078 | Absent | Absent | Present Example |
| 74 | BV | 45 | 26 | 29 | 0.04 | 17.5 | 4.3 | 2.45 | 0.03 | 0.03 | 3.2 | −14.3 | 888 | 978 | 73 | 39 | 0.079 | Absent | Absent | Comparative Example |
| 75 | A | 61 | 25 | 14 | 0.05 | 17.4 | 4.4 | 2.7 | 0.04 | 0.6 | 2.6 | −48.6 | 961 | 1073 | 64 | 31 | 0.066 | Absent | Absent | Comparative Example |
| 76 | A | 54 | 26 | 20 | 0.05 | 17.4 | 6.2 | 2.8 | 0.03 | 0.3 | 1.3 | −93.0 | 777 | 901 | 89 | 44 | 0.081 | Absent | Absent | Present Example |
| 77 | A | 52 | 32 | 16 | 0.07 | 17.2 | 3.9 | 2.1 | 0.02 | 1.0 | 1.9 | −16.5 | 777 | 901 | 113 | 60 | 0.077 | Absent | Absent | Present Example |
| 78 | A | 61 | 22 | 17 | 0.05 | 17.7 | 3.9 | 2.8 | 0.04 | 1.2 | 1.9 | −45.9 | 794 | 891 | 50 | 19 | 0.064 | Absent | Absent | Comparative Example |
| 79 | A | 55 | 32 | 13 | 0.04 | 17.5 | 4.3 | 2.8 | 0.03 | 1.1 | 3.2 | −43.3 | 941 | 1051 | 85 | 43 | 0.049 | Absent | Absent | Present Example |
| 80 | A | 52 | 32 | 16 | 0.05 | 17.1 | 4.3 | 2.8 | 0.02 | 1.1 | 1.3 | −10.7 | 736 | 850 | 80 | 44 | 0.056 | Absent | Absent | Comparative Example |
| 81 | A | 53 | 26 | 21 | 0.04 | 17.5 | 4.3 | 2.6 | 0.03 | 1.2 | 1.2 | −12.9 | 777 | 884 | 93 | 46 | 0.055 | Absent | Absent | Present Example |
| 82 | A | 63 | 26 | 11 | 0.04 | 17.5 | 4.3 | 2.45 | 0.03 | 0.03 | 3.2 | −14.3 | 731 | 840 | 68 | 31 | 0.144 | Absent | Absent | Comparative Example |
| 83 | A | 60 | 25 | 15 | 0.05 | 17.4 | 4.4 | 2.7 | 0.04 | 0.6 | 2.6 | −48.6 | 768 | 876 | 106 | 57 | 0.077 | Absent | Absent | Present Example |
| 84 | A | 39 | 37 | 24 | 0.05 | 17.4 | 6.2 | 2.8 | 0.03 | 0.3 | 1.3 | −93.0 | 748 | 854 | 95 | 46 | 0.064 | Absent | Absent | Comparative Example |
| 85 | A | 63 | 22 | 15 | 0.04 | 17.5 | 4.3 | 2.6 | 0.03 | 1.2 | 1.2 | −12.9 | 777 | 901 | 113 | 60 | 0.049 | Absent | Absent | Present Example |
| 86 | A | 61 | 22 | 17 | 0.04 | 17.5 | 4.3 | 2.45 | 0.03 | 0.03 | 3.2 | −14.3 | 912 | 1030 | 87 | 46 | 0.077 | Absent | Absent | Present Example |

TABLE 6-continued

| Steel pipe No. | Steel type | Structure after heat treatment step: Volume fraction of tempered martensite phase (%) | Volume fraction of ferrite phase (%) | Volume fraction of residual austenite phase (%) | Chemical composition of residual austenite phase: C (mass %) | Cr (mass %) | Ni (mass %) | Mo (mass %) | N (mass %) | W (mass %) | Cu (mass %) | $Md_{30}$*2 (° C.) | Tensile characteristics: Yield strength YS (MPa) | Tensile strength TS (MPa) | Low-temperature toughness: $vE_{-10}$ (J) | $vE_{-40}$ (J) | Corrosion characteristics: Corrosion rate (mm/y) | SSC resistance Cracking*3 | SCC resistance Cracking*3 | Remarks |
|---|---|---|---|---|---|---|---|---|---|---|---|---|---|---|---|---|---|---|---|---|
| 87 | A | 55 | 32 | 13 | 0.05 | 17.4 | 4.3 | 2.6 | 0.04 | 0.3 | 1.3 | −21.0 | 941 | 1051 | 50 | 11 | 0.064 | Absent | Absent | Comparative Example |
| 88 | A | 60 | 29 | 11 | 0.05 | 17 | 4.4 | 2.45 | 0.03 | 1.0 | 2.4 | −18.1 | 960 | 1076 | 86 | 41 | 0.049 | Absent | Absent | Present Example |
| 89 | A | 63 | 22 | 15 | 0.07 | 17.1 | 6.2 | 2.7 | 0.02 | 0.9 | 2.6 | −130.9 | 792 | 904 | 48 | 10 | 0.056 | Absent | Absent | Comparative Example |
| 90 | A | 61 | 22 | 17 | 0.04 | 17.5 | 4.3 | 2.6 | 0.03 | 1.2 | 1.2 | −12.9 | 870 | 965 | 88 | 44 | 0.055 | Absent | Absent | Present Example |
| 91 | A | 55 | 32 | 13 | 0.04 | 17.5 | 4.3 | 2.45 | 0.03 | 0.03 | 3.2 | −14.3 | 960 | 1076 | 76 | 20 | 0.078 | Absent | Absent | Comparative Example |
| 92 | A | 61 | 22 | 17 | 0.05 | 17.4 | 4.4 | 2.7 | 0.04 | 0.6 | 2.6 | −48.6 | 792 | 904 | 89 | 43 | 0.079 | Absent | Absent | Present Example |
| 93 | A | 55 | 32 | 13 | 0.05 | 17.4 | 6.2 | 2.8 | 0.03 | 0.3 | 1.3 | −93.0 | 870 | 965 | 77 | 37 | 0.066 | Absent | Absent | Comparative Example |
| 94 | A | 54 | 26 | 20 | 0.07 | 17.2 | 3.9 | 2.1 | 0.02 | 1.0 | 1.9 | −16.5 | 792 | 904 | 93 | 50 | 0.081 | Absent | Absent | Present Example |

*1Underline means outside the range of the present invention.

*2$Md_{30} = 1148 - 1775C - 44Cr - 39Ni - 37Mo - 698N - 15W - 13Cu \leq -10$ . . . Formula (1)

C, Cr, Ni, Mo, N, W, and Cu represent the content of each element in the residual austenite phase in mass % (the content being 0 (zero) for elements that are not contained).

The Present Examples all had high strength with a yield strength of 758 MPa or more, and low-temperature toughness with an absorption energy at −10° C. of 80 J or more.

The high strength seamless stainless steel pipes of the Present Examples also had excellent corrosion resistance (carbon dioxide corrosion resistance) in a $CO_2$— and $Cl^-$-containing high-temperature corrosive environment of 200° C., and excellent sulfide stress cracking resistance and sulfide stress corrosion cracking resistance that did not involve cracking (SSC, SCC) in the $H_2S$-containing environment. On the other hand, the Comparative Examples outside of the range of the present invention did not have the desired high strength, low-temperature toughness, carbon dioxide corrosion resistance, sulfide stress cracking resistance (SSC resistance), and/or sulfide stress corrosion cracking resistance (SCC resistance) according to aspects of the present invention.

The invention claimed is:

1. A high strength seamless stainless steel pipe of a composition comprising, in mass %, C: 0.012 to 0.05%, Si: 1.0% or less, Mn: 0.1 to 0.5%, P: 0.05% or less, S: 0.005% or less, Cr: more than 16.0% and 18.0% or less, Mo: more than 2.0% and 3.0% or less, Cu: 0.5 to 3.5%, Ni: 3.0% or more and less than 5.0%, W: 0.01 to 3.0%, Nb: 0.01 to 0.5%, Al: 0.001 to 0.1%, N: 0.012 to 0.07%, O: 0.01% or less, and the balance Fe and unavoidable impurities, the high strength seamless stainless steel pipe having a structure that includes a tempered martensite phase as a primary phase, and 20 to 40% ferrite phase, and greater than zero and at most 25% stabilized residual austenite phase in terms of a volume fraction, and in which C, Cr, Ni, Mo, N, W, and Cu in the residual austenite phase satisfy the following formula (1):

$$Md_{30}=1148-1775C-44Cr-39Ni-37Mo-698N-15W-13Cu\leq-10, \quad \text{Formula (1)}$$

wherein C, Cr, Ni, Mo, N, W, and Cu represent the content of each element in the residual austenite phase in mass %, the content being 0 (zero) for elements that are not contained.

2. The high strength seamless stainless steel pipe according to claim 1, wherein the composition further comprises, in mass %, at least one selected from Ti: 0.3% or less, V: 0.5% or less, Zr: 0.2% or less, Co: 1.4% or less, Ta: 0.1% or less, and B: 0.0100% or less.

3. The high strength seamless stainless steel pipe according to claim 1, wherein the composition further comprises, in mass %, at least one selected from Ca: 0.0005 to 0.0050%, and REM: 0.001 to 0.01%.

4. The high strength seamless stainless steel pipe according to claim 2, wherein the composition further comprises, in mass %, at least one selected from Ca: 0.0005 to 0.0050%, and REM: 0.001 to 0.01%.

5. A method for producing the high strength seamless stainless steel pipe according to claim 1 from a steel pipe material of a composition containing, in mass %, C: 0.012 to 0.05%, Si: 1.0% or less, Mn: 0.1 to 0.5%, P: 0.05% or less, S: 0.005% or less, Cr: more than 16.0% and 18.0% or less, Mo: more than 2.0% and 3.0% or less, Cu: 0.5 to 3.5%, Ni: 3.0% or more and less than 5.0%, W: 0.01 to 3.0%, Nb: 0.01 to 0.5%, Al: 0.001 to 0.1%, N: 0.012 to 0.07%, O: 0.01% or less, and the balance Fe and unavoidable impurities, the method comprising:

heating the steel pipe material at a heating temperature of 1,100 to 1,300° C., and forming a seamless steel pipe of a predetermined shape by hot working;

heating the seamless steel pipe to a quenching temperature of 850 to 1,150° C. after the hot working;

quenching the seamless steel pipe by cooling the seamless steel pipe at an average cooling rate of 0.05° C/s or more to a cooling stop temperature at which the seamless steel pipe has a surface temperature of 50° C. or less and more than 0° C.;

subjecting the seamless steel pipe to an austenite stabilizing heat treatment in which the seamless steel pipe is heated to a temperature of 200 to 500° C., and air cooled; and tempering the seamless steel pipe by heating the seamless steel pipe to a tempering temperature of 500 to 650° C.

6. The method for producing a high strength seamless stainless steel pipe according to claim 5, wherein the composition further contains, in mass %, at least one selected from Ti: 0.3% or less, V: 0.5% or less, Zr: 0.2% or less, Co: 1.4% or less, Ta: 0.1% or less, and B: 0.0100% or less.

7. The method for producing a high strength seamless stainless steel pipe according to claim 5, wherein the composition further contains, in mass %, at least one selected from Ca: 0.0005 to 0.0050%, and REM: 0.001 to 0.01%.

8. The method for producing a high strength seamless stainless steel pipe according to claim 6, wherein the composition further contains, in mass %, at least one selected from Ca: 0.0005 to 0.0050%, and REM: 0.001 to 0.01%.

* * * * *